US011247451B2

(12) United States Patent
Matsubara et al.

(10) Patent No.: US 11,247,451 B2
(45) Date of Patent: Feb. 15, 2022

(54) PRINTING APPARATUS

(71) Applicant: ASAHI KASEI KABUSHIKI KAISHA, Tokyo (JP)

(72) Inventors: Shinya Matsubara, Tokyo (JP); Taishi Hitomi, Tokyo (JP); Masayuki Abe, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 219 days.

(21) Appl. No.: 16/342,808

(22) PCT Filed: Oct. 18, 2017

(86) PCT No.: PCT/JP2017/037721
§ 371 (c)(1),
(2) Date: Apr. 17, 2019

(87) PCT Pub. No.: WO2018/074521
PCT Pub. Date: Apr. 26, 2018

(65) Prior Publication Data

US 2020/0055305 A1 Feb. 20, 2020

(30) Foreign Application Priority Data

Oct. 18, 2016 (JP) ..... JP2016-204466
Nov. 14, 2016 (JP) ..... JP2016-221970
Dec. 8, 2016 (JP) ..... JP2016-238651

(51) Int. Cl.
*B41F 13/40* (2006.01)

(52) U.S. Cl.
CPC ..... *B41F 13/40* (2013.01)

(58) Field of Classification Search
CPC ..... B41F 13/30; B41F 31/302; B41F 31/30; B41F 31/307; B41F 5/24; B41F 13/40; H05K 3/1275; H05K 3/12
See application file for complete search history.

(56) References Cited

U.S. PATENT DOCUMENTS 4,361,089 A 11/1982 Wittkopf et al.
4,413,560 A 11/1983 Rogge
(Continued)

FOREIGN PATENT DOCUMENTS

DE 102009005821 A1 7/2010
EP 1158189 A1 11/2001
(Continued)

OTHER PUBLICATIONS

Partial Supplementary European Search Report, dated Jul. 23, 2019, for European Application No. 17863033.1.
(Continued)

*Primary Examiner* — Leslie J Evanisko
*Assistant Examiner* — Leo T Hinze
(74) *Attorney, Agent, or Firm* — Birch, Stewart, Kolasch & Birch, LLP

(57) ABSTRACT

In order to reduce variations in pressing force of a printing nip to make the printing pressure uniform, an apparatus that performs printing on a substrate using a roll-to-roll method according to an aspect of the present application includes: an ink supply member that supplies a printing ink; a blanket cylinder (30) that transfers part of the ink, which has been supplied from the ink supply member and applied on a surface of the blanket cylinder, onto the substrate; a roller mold (40) that removes part of the ink applied on the surface of the blanket cylinder (30); a base (46) on which the blanket cylinder (30) is fixed; a slider (44) that supports the roller mold (40) and moves on the base (46); a moving resistance reduction device (80) that reduces a moving resistance of the slider (44) relative to the base (46); and a roller mold nip device (42) that applies, to the roller mold (40), a nip pressure against the blanket cylinder (30).

17 Claims, 21 Drawing Sheets

(56) References Cited

U.S. PATENT DOCUMENTS

| | | | | |
|---|---|---|---|---|
| 5,099,760 | A * | 3/1992 | Schneider | B23Q 1/68 101/351.4 |
| 6,125,752 | A | 10/2000 | Freddo et al. | |
| 2002/0189478 | A1 | 12/2002 | Furukawa et al. | |
| 2009/0283000 | A1 | 11/2009 | Nomoto | |
| 2012/0167790 | A1 | 7/2012 | Suzuki et al. | |
| 2015/0173199 | A1 | 6/2015 | Seong et al. | |
| 2015/0191006 | A1 | 7/2015 | Shifley | |
| 2016/0059540 | A1 | 3/2016 | Smith et al. | |

FOREIGN PATENT DOCUMENTS

| | | | |
|---|---|---|---|
| EP | 2574459 | A2 | 4/2013 |
| JP | 5-200973 | A | 8/1993 |
| JP | 11-334029 | A | 12/1999 |
| JP | 2000-98769 | A | 4/2000 |
| JP | 2002-36512 | A | 2/2002 |
| JP | 2002-248743 | A | 9/2002 |
| JP | 2002-370466 | A | 12/2002 |
| JP | 2006-276349 | A | 10/2006 |
| JP | 2007-136776 | A | 6/2007 |
| JP | 2007-268714 | A | 10/2007 |
| JP | 2007-268870 | A | 10/2007 |
| JP | 2008-55707 | A | 3/2008 |
| JP | 2006-256216 | A | 9/2008 |
| JP | 2009-172835 | A | 8/2009 |
| JP | 2009-274299 | A | 11/2009 |
| JP | 2010-94947 | A | 4/2010 |
| JP | 2011-37170 | A | 2/2011 |
| JP | 2011-56778 | A | 3/2011 |
| JP | 2012-240786 | A | 12/2012 |
| JP | 2013-35285 | A | 2/2013 |
| JP | 2013-543251 | A | 11/2013 |
| JP | 2014-237262 | A | 12/2014 |
| JP | 2015-523244 | A | 8/2015 |
| JP | 2016-509528 | A | 3/2016 |
| JP | 2016-132522 | A | 7/2016 |
| KR | 10-2011-0040181 | A | 4/2011 |
| KR | 10-2012-0078875 | A | 7/2012 |
| KR | 10-2012-0129786 | A | 11/2012 |
| KR | 10-1409488 | B1 | 6/2014 |
| WO | WO 2012/013508 | A1 | 2/2012 |
| WO | WO 2014/099507 | A1 | 6/2014 |

OTHER PUBLICATIONS

English translation of the International Preliminary Report on Patentability and Written Opinion of the International Searching Authority, dated Apr. 23, 2019, for International Application No. PCT/JP2017/037721.

International Preliminary Report on Patentability and Written Opinion of the International Searching Authority dated Apr. 23, 2019, for International Application No. PCT/JP2017/037721.

International Search Report (PCT/ISA/210) issued in PCT/JP2017/037721, dated Jan. 16, 2018.

Supplementary European Search Report, dated Nov. 14, 2019, for European Application No. 17863033.1.

European Search Report, dated Jan. 26, 2021, for European Serial No. 20204876.5.

* cited by examiner

FIG. 15

| | MOVING RESISTANCE | VARIATIONS IN PRINTING PRESSURE |
|---|---|---|
| TARGET VALUE | ≦0.3N | ≦1.5% |
| ACHIEVED VALUE | ≦0.03N | ≦0.04% |

MOVING RESISTANCE COMMERCIAL NIP:0.68N vs ULTRA-HIGH PRECISION NIP:0.03N

<COMMERCIAL NIP(CONTACT GUIDE)>

<ULTRA-HIGH PRECISION NIP(AIR-FLOATED GUIDE)>

LOAD PRECISION ≦ 0.02N(PRESET LOAD 50N,PRESSING TIME:0.5sec)

VARIATIONS IN PRINTING PRESSURE 0.02N/50N=0.04%

PRINTING APPARATUS

TECHNICAL FIELD

The present invention relates to a printing apparatus such as a reverse printing apparatus and a roll-to-roll printing apparatus.

BACKGROUND ART

In recent years, developments have been made in techniques for manufacturing electronic devices using printing processes. Among such techniques, a reverse (reverse offset) printing method, which is a technique for printing electronic devices with a high resolution of, for example, 10 microns or less, has been studied and developments in printing apparatuses have been promoted.

In order to perform high precision printing using a printing apparatus, printing pressure needs to be made uniform. Conventionally, printing pressure may be made uniform by employing a constant pressing amount of a printing nip (which conveys the meaning of "pressing" and will be simply referred to as an "NIP" in some contexts in this specification and in the drawings) (see, for example, patent documents 1 to 3).

CITATION LIST

Patent Document

Patent Document 1: JP2000-098769 A
Patent Document 2: JP2002-036512 A
Patent Document 3: JP2011-056778 A

SUMMARY

Technical Problem

However, even if a constant pressing amount of the printing nip is employed, it is still possible that variations in the pressing pressure will occur due to nonuniform flatness (planographic plate) and cylindricity (roll) of an object to which the nip is applied. Even if constant pressing force of the printing nip is employed, it is still possible that sliding resistance (moving resistance) will be generated in a guide (linear guide) which supports a nip operation and causes variations in printing pressure.

An object of the present invention is to provide a printing apparatus in which variations in pressing force of a printing nip have been reduced to improve uniformity of the printing pressure.

Solution to Problem

In order to solve the problems set forth above, a printing apparatus according to an aspect of the invention is a printing apparatus that performs printing on a substrate using a roll-to-roll method, the apparatus including: an ink supply member that supplies a printing ink; a blanket cylinder that transfers part of the ink, which has been supplied from the ink supply member and applied on a surface of the blanket cylinder, onto the substrate; a roller mold that removes part of the ink applied on the surface of the blanket cylinder; a base on which the blanket cylinder is fixed; a slider that supports the roller mold and moves on the base; a moving resistance reduction device that reduces a moving resistance of the slider relative to the base; and a roller mold nip device that applies to the roller mold a nip pressure against the blanket cylinder.

In such printing apparatus, since the moving resistance of the slider relative to the base is reduced by the moving resistance reduction device, variations in the pressing force of the printing nip can be easily suppressed and reduced. With such configuration, it is possible to make the printing pressure uniform.

Specifically, if position control is performed using the pressing amount as a parameter as in conventional printing apparatuses, variations in the printing pressure are generated as described above. On the other hand, in the printing apparatus with the reduced moving resistance of the slider according to the above aspect of the invention, variations in the printing pressure resulting from external factors are absorbed and eliminated and the printing pressure can therefore be made uniform. As a result, the printing quality can be improved.

In the above-mentioned printing apparatus, the roller mold nip device may control pressing force applied to the slider using the nip pressure as a parameter In the above-mentioned printing apparatus, the moving resistance reduction device may be an air blowing device that floats the slider above the base.

In the above-mentioned printing apparatus, the roller mold nip device may press the slider via a force point.

In the above-mentioned printing apparatus, the force point may be arranged at the same height as a height of an axis of rotation of the roller mold.

In the above-mentioned printing apparatus, the slider may be provided with air blowing ports through which the air is blown out to the base.

In the above-mentioned printing apparatus, the slider may include air pads or air guides.

In the above-mentioned printing apparatus, the air blowing ports may be arranged in line symmetry with respect to an axis of symmetry perpendicular to a moving direction of the slider.

The above-mentioned printing apparatus may further include a guide member that guides the slider only in a direction which causes the roller mold to move to and away from the blanket cylinder.

In the above-mentioned printing apparatus, the guide member guides the slider in a direction perpendicular to an axis of rotation of the blanket cylinder.

In the above-mentioned printing apparatus, the air pads are arranged in an equal distance from the center of gravity of the slider and devices supported by the slider.

A reverse printing apparatus according to another aspect of the invention further includes, in the above-mentioned printing apparatus, a printing plate cleaning member that cleans the roller mold and strips off ink that has adhered to the roller mold, wherein the printing apparatus performs seamless reverse printing on the substrate.

In the reverse printing apparatus, part of the ink which has been applied on the surface of the blanket cylinder is removed by the roller mold and the remaining ink is transferred onto the substrate. The blanket cylinder can continuously perform seamless printing on the substrate using a roll-to-roll method by transferring the ink onto the substrate while being rotated.

Further, in such reverse printing apparatus, since the reverse printing is performed with the ink adhering to the roller mold being stripped off by the roller mold cleaning member, it is possible to continuously perform the reverse printing while maintaining the function of removing part of the ink by the roller mold.

In the above-mentioned reverse printing apparatus, the roller mold, the blanket cylinder and an impression cylinder that presses the substrate into contact with the blanket cylinder may be arranged in a linear manner.

In the above-mentioned reverse printing apparatus, an axis of rotation of the roller mold, an axis on rotation of the blanket cylinder, the impression cylinder, and an impression cylinder that presses the substrate into contact with the blanket cylinder may be arranged on a horizontal plane In the above-mentioned reverse printing apparatus, an axis of rotation of the blanket cylinder may be fixed and the roller mold may be provided so as to be moveable relative to the blanket cylinder.

In the above-mentioned reverse printing apparatus, the roller mold cleaning member may be provided in an integrated manner with the roller mold.

In the above-mentioned reverse printing apparatus, the blanket cylinder may be formed of PDMS.

In the above-mentioned reverse printing apparatus, the ink supply member, the roller mold and the impression cylinder may be arranged around the blanket cylinder, in order of mention in a rotation direction of the blanket cylinder.

A roll-to-roll printing apparatus according to further aspect of the invention includes a feed unit that feeds a substrate, a plurality of printing units that performs overlay printing on the substrate fed from the feed unit, and a take-up unit that takes up the substrate on which printing has been performed by the printing units, and performs seamless printing on the substrate using a roll-to-roll method, the roll-to-roll printing apparatus including: drive rolls that convey the substrate; a drive roll actuator that drives the drive rolls; a dancer roll actuator arranged between the drive rolls, the dancer roll actuator changing a tension of the substrate by changing a path line length of the substrate; a tension detecting device that detects the tension of the substrate; an image detecting device that detects an image of an overlay print portion formed on the substrate by a second or subsequent printing unit; and a tension control device that compensates for a tension fluctuation of the substrate by controlling the drive roll actuator and the dancer roll actuator based on a detection result of the tension detecting device and a detection result of the image detecting device, in which: a steady state is created such that the tension fluctuation of the substrate is compensated for and suppressed by the tension control device; and an alignment error, which is a difference between print positions in the respective printing units, is reduced by the dancer roll actuator to improve an alignment precision.

The dancer roll actuator is excellent in terms of responsibility and is capable of, for example, reducing physical friction resistance. Thus, by employing such dancer roll actuator having higher readiness and higher precision (more sensitive) actuator performances than typical dancer rolls, a difference in sensitivity properties can be generated and it is therefore possible to control the tension of the substrate and suppress its tension fluctuation with higher precision than that achieved with a conventional combination of a dancer roll and an actuator that drives the dancer roll. Accordingly, while tension control has been typically performed by displacing a drive roll using an actuator to compensate for the tension fluctuation in conventional printing apparatuses, it is possible to control the tension fluctuation with high precision by performing finer tension control using the dancer roll actuator in the roll-to-roll printing apparatus according to the above aspect of the invention.

In addition, in the roll-to-roll printing apparatus according to the above aspect of the invention which performs overlay printing using the second or subsequent printing units from among the plurality of printing units: a misalignment in the overlay printing is detected; the role of compensating for the tension fluctuation is given to the drive roll whose range of motion is not restricted, in order to create a steady state with a suppressed tension fluctuation; and the dancer roll actuator is used to constitute the control mechanism for enhancing the alignment precision. Thus, it is possible to improve the alignment precision in the overlay printing by finely controlling the tension of the substrate.

The dancer roll actuator may be arranged between two successive drive rolls.

The tension control device may use the dancer roll actuator to perform feed-forward control for the drive roll actuator of the drive roll arranged after the dancer roll actuator.

Advantageous Effects of Invention

According to the present invention, it is possible to reduce variations in the pressing force of the printing nip to thereby make the printing pressure uniform.

BRIEF DESCRIPTION OF DRAWINGS

FIG. 15 is a table showing a target value of a moving resistance of a slider before an experimental production of a printing apparatus and an actual value achieved after the experimental production.

DESCRIPTION OF EMBODIMENTS

First Embodiment

Now, preferred embodiments of a roll-to-roll printing apparatus to which the invention is applied will be described below with reference to the attached drawings (see FIGS. 1 to 14).

Figure 3:
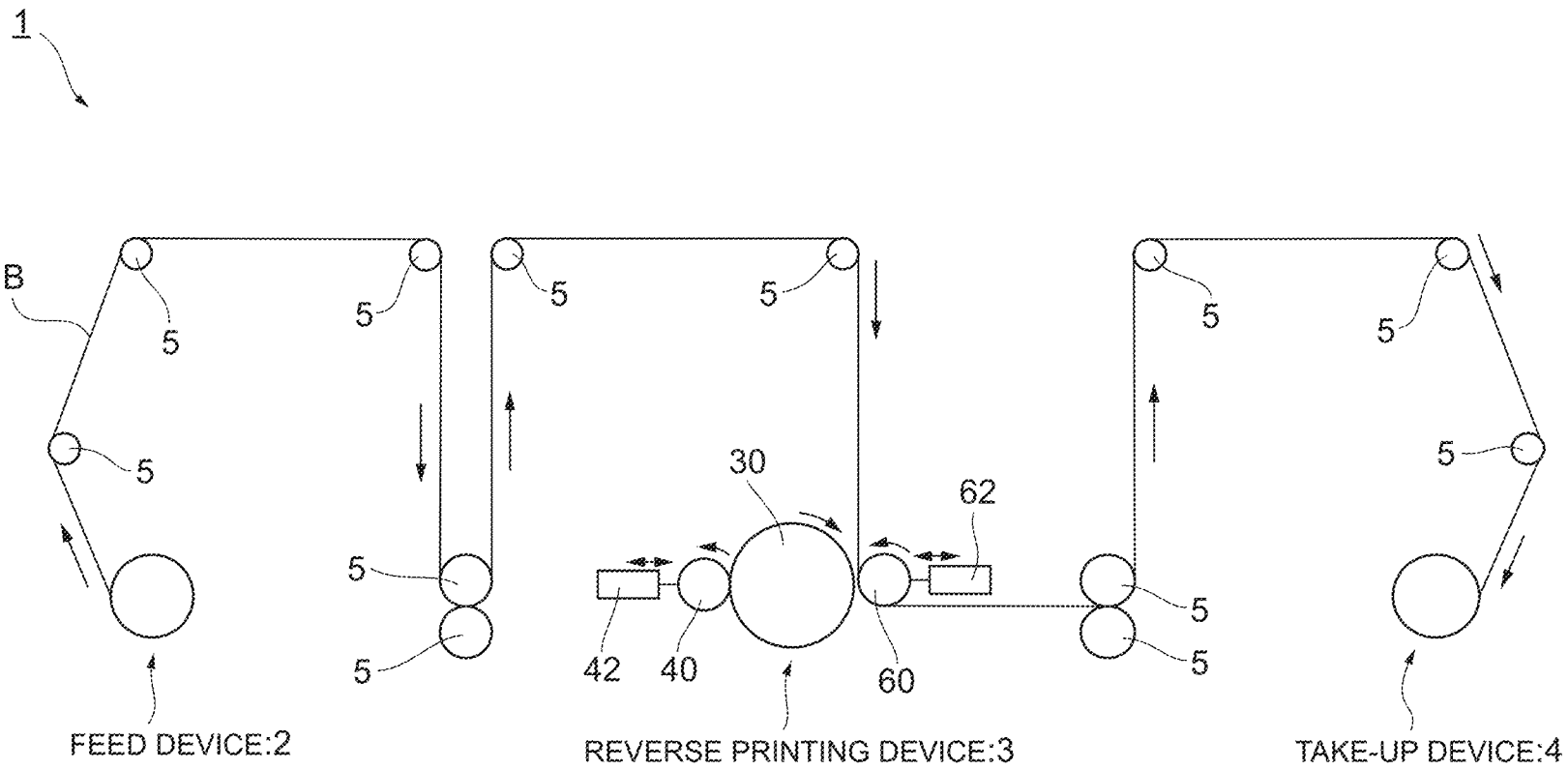
FIG. 3 is a diagram showing an outline of devices constituting a roll-to-roll printing apparatus and a conveyance path for conveying a substrate (film).
Figure 4:
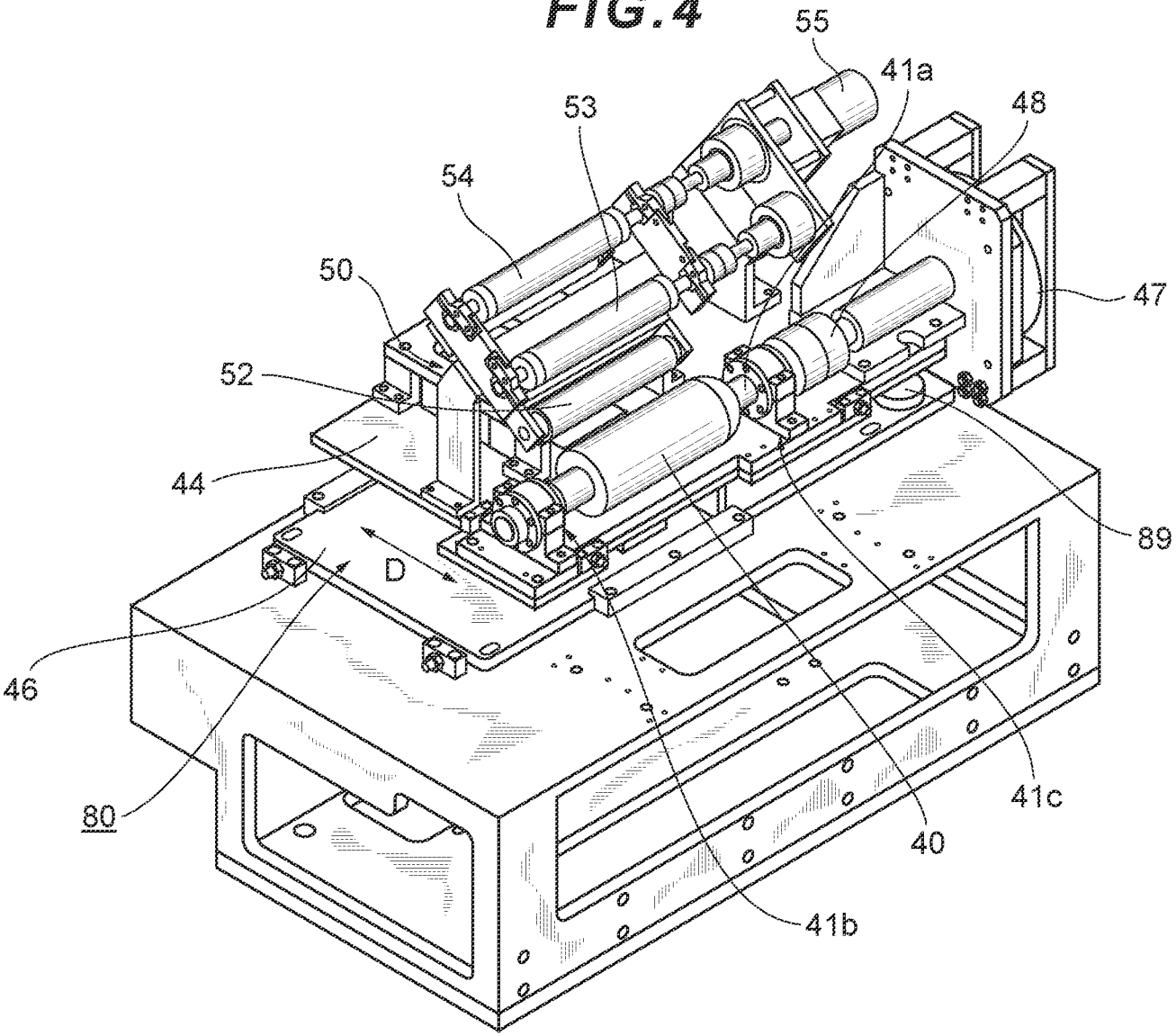
FIG. 4 is a perspective view of a configuration example of a moving resistance reduction device of a slider (roller mold supporting member) in a printing apparatus, as seen from the upper right on the front side.
Figure 5:
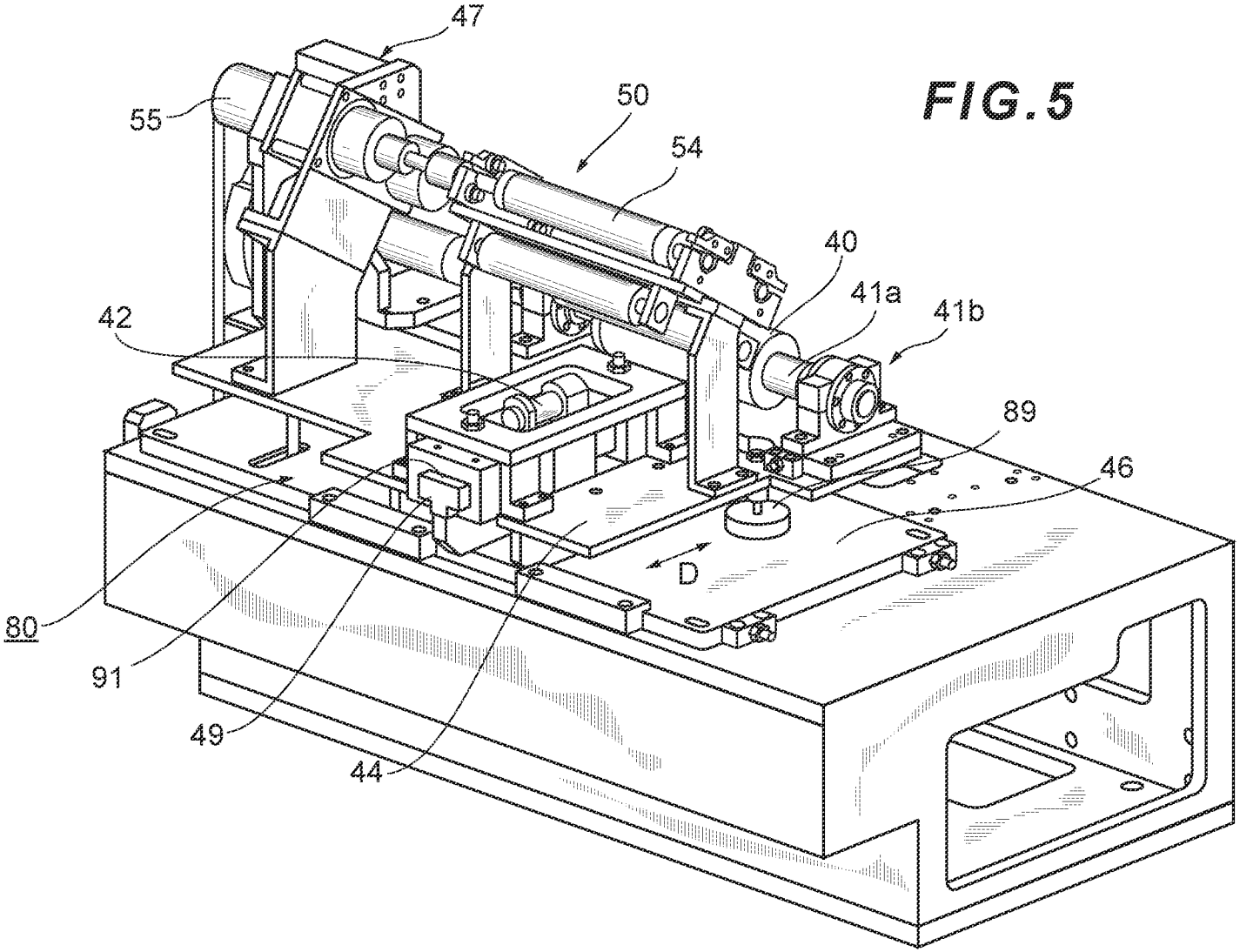
FIG. 5 is a perspective view of a configuration example of the moving resistance reduction device of the slider (roller mold supporting member) in the printing apparatus, as seen from the upper right on the rear side.
Figure 6:
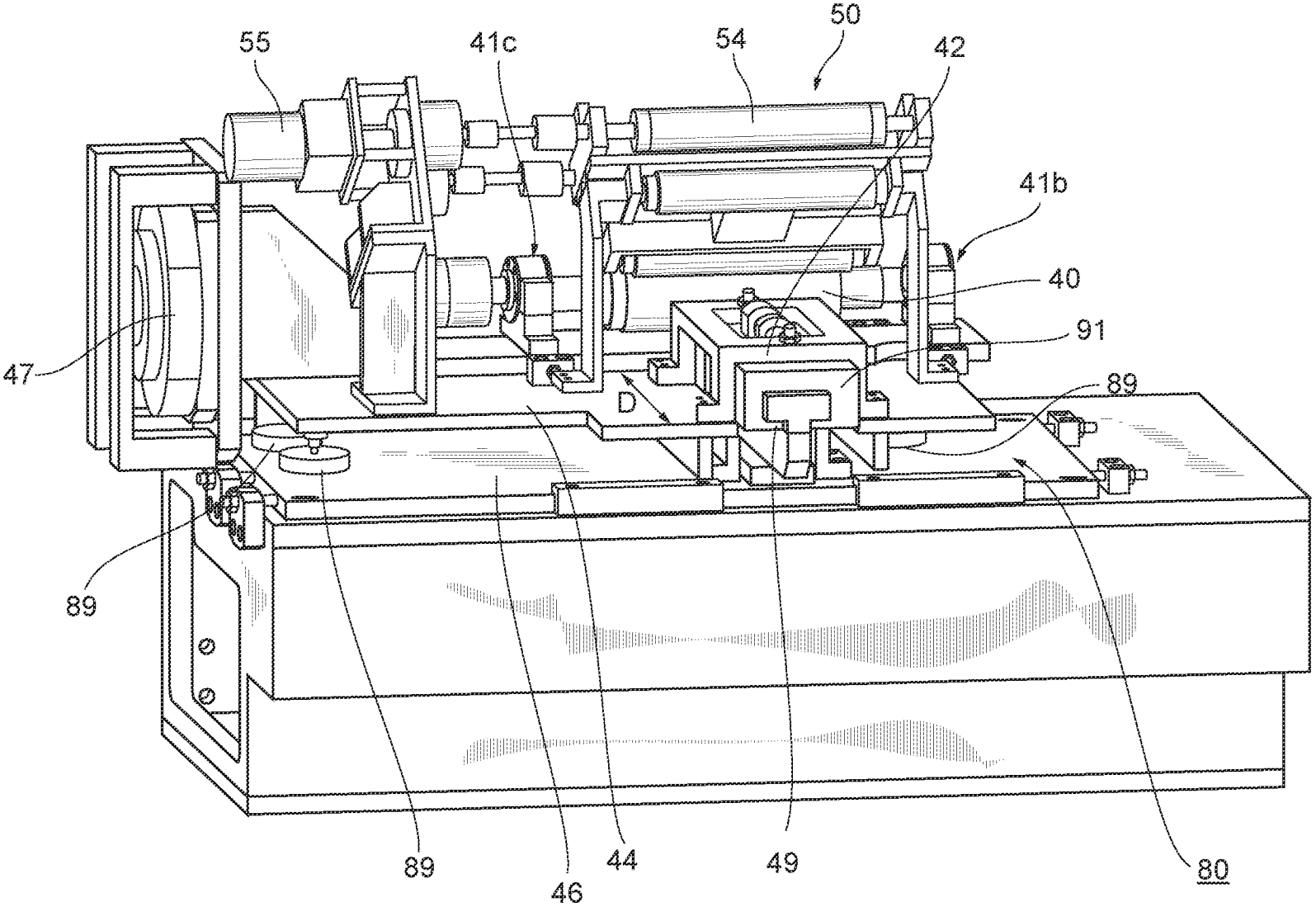
FIG. 6 is a perspective view of a configuration example of the moving resistance reduction device of the slider (roller mold supporting member) in the printing apparatus, as seen from the upper left on the rear side.
Figure 7:
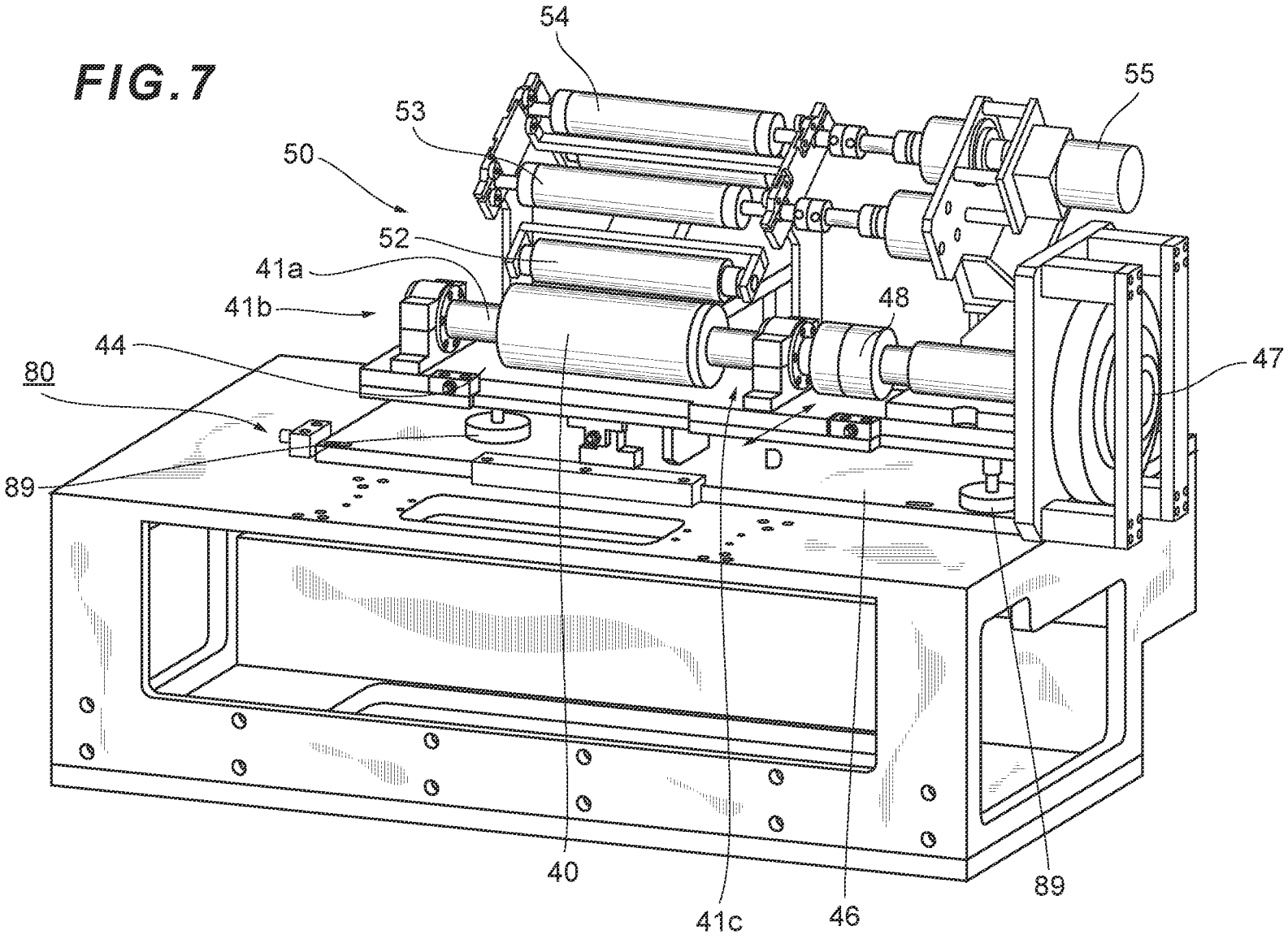
FIG. 7 is a perspective view of a configuration example of the moving resistance reduction device of the slider (roller mold supporting member) in the printing apparatus, as seen from the upper left on the front side.

A roll-to-roll printing apparatus 1 includes a feed device 2, a reverse printing device 3, a take-up device 4, and others (see FIG. 3). In the roll-to-roll printing apparatus 1, a rolled substrate B is first fed by the feed device 2, conveyed to the reverse printing device 3 by a conveyance device constituted by various rollers 5, etc., and subjected to reverse printing. After printing, the substrate B is conveyed by the conveyance device to the take-up device 4 where the substrate B is taken up into a roll.

The substrate B may be formed of, for example, a flexible film, a surface of which is subjected to printing by the reverse printing device 3. The substrate B is initially in a rolled shape, which is then fed by the feed device 2 from the rolled shape and sent along a predetermined path (see the arrows in FIG. 1) into a printing step where an ink pattern is transferred onto the substrate B by the reverse printing device 3. After the printing step, the substrate B is subjected to steps, such as a drying step and a tension detecting step (not shown), and taken up into a roll by the take-up device 4.

The reverse printing device 3 is a device for performing printing on the substrate B. The reverse printing device 3 in the present embodiment includes an ink supply member 20, a blanket cylinder 30, a roller mold 40 and a roller mold cleaning member 50 (see FIG. 1) and further includes an impression cylinder 60 (see FIG. 2).

The ink supply member (coating device) 20 is a member (device) for supplying a printing ink K to the blanket cylinder 30. For example, the ink supply member 20 of the present embodiment may be arranged directly below (on the lower side in the vertical direction of) the blanket cylinder 30 and constituted by a slit die coater (which is also referred to as a "slot die coater") which applies the ink K on the blanket cylinder 30. However, such arrangement and configuration are merely preferred examples.

The blanket cylinder 30 transfers the ink K onto a surface of the substrate B while being rotated. Part of the ink K applied on a surface of the blanket cylinder 30 is removed by the roller mold 40. The ink K which remains unremoved on the surface of the blanket cylinder 30 is transferred to the substrate B (see FIG. 2). The blanket cylinder 30 is formed of a soft and easily-deformable material such as PDMS (polydimethylsiloxane). The roller mold 40 removes part of the ink according to a pattern (pattern removal). The roller mold 40 of the present embodiment is brought into contact with the surface of the blanket cylinder 30, while being rotated along with a rotary shaft 41*a* supported by bearings 41*b* and 41*c* in a direction reverse to the rotation of the blanket cylinder 30, to remove unnecessary portions of the ink (see FIGS. 1, 2 and 8 to 10).

Figure 8:
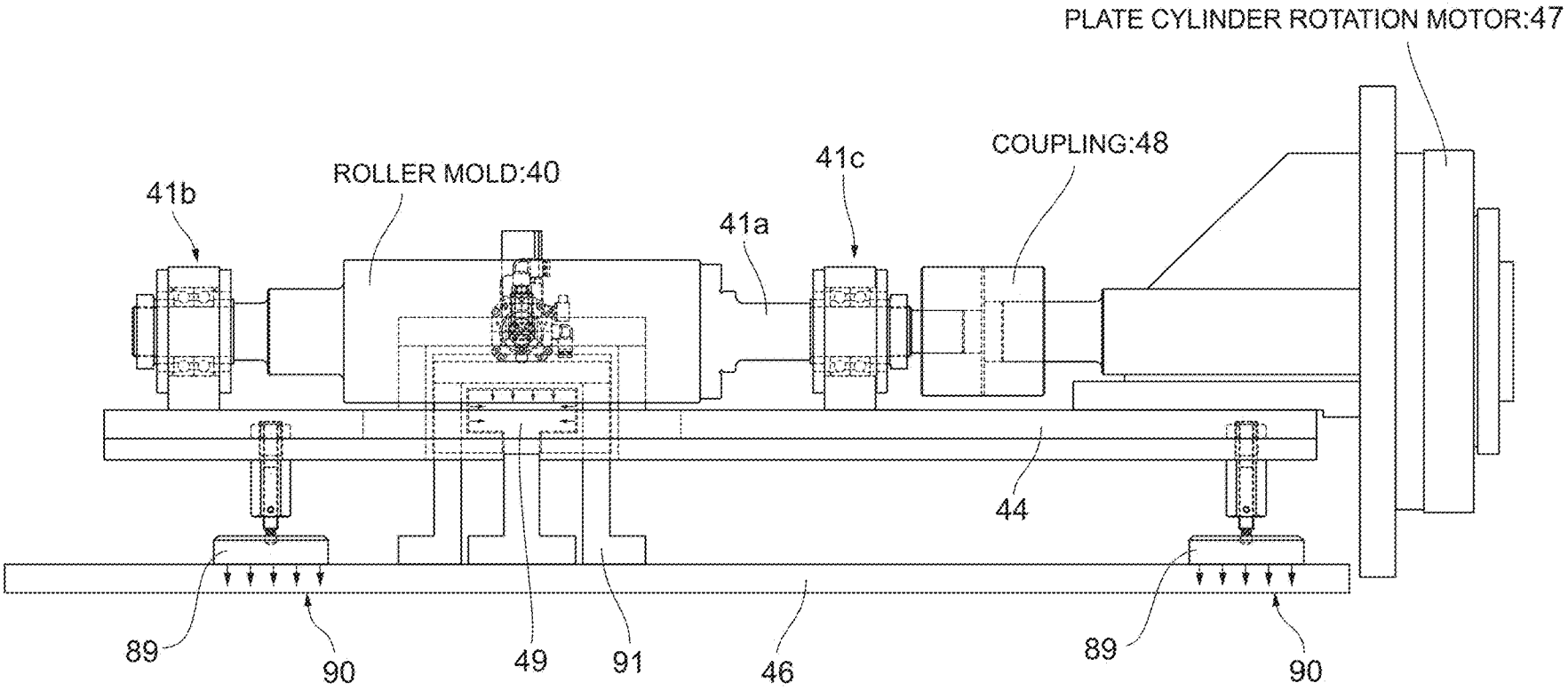
FIG. 8 is a diagram showing a configuration example of a roller mold and its driving source, as seen from the front side.
Figure 9:
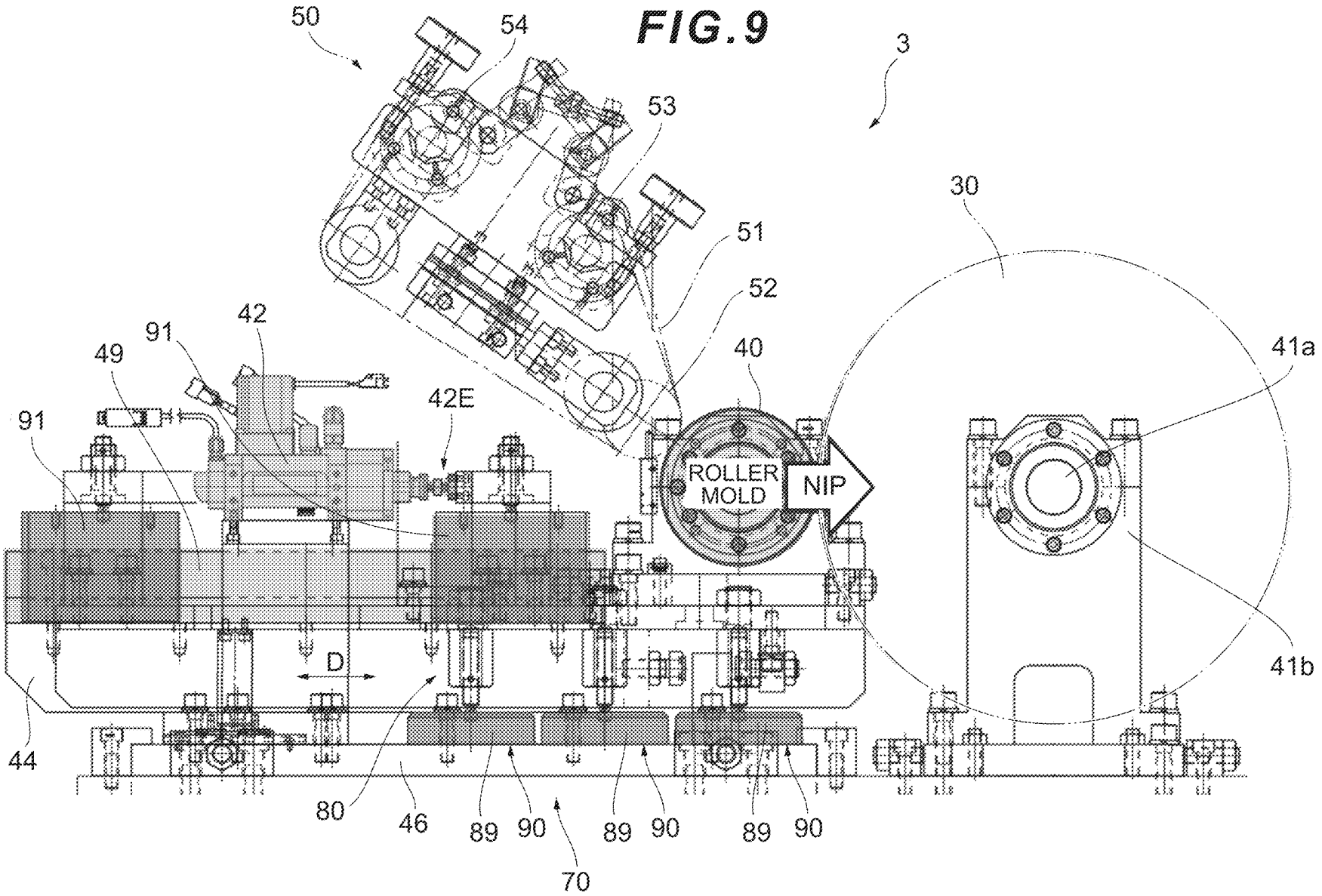
FIG. 9 is a side view of the devices shown in FIG. 8.
Figure 10:
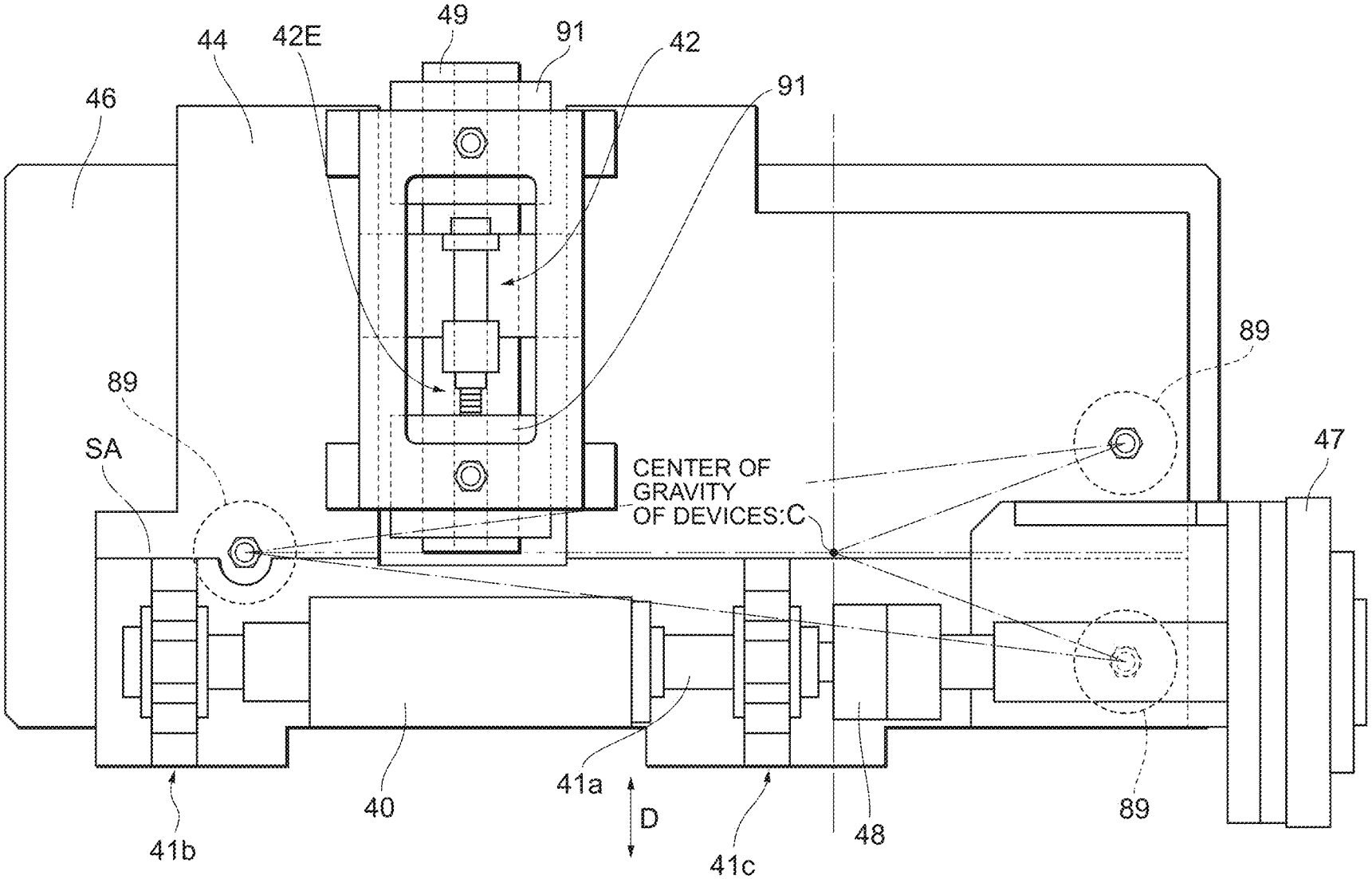
FIG. 10 is a plan view of the devices shown in FIG. 8.
Figure 11:
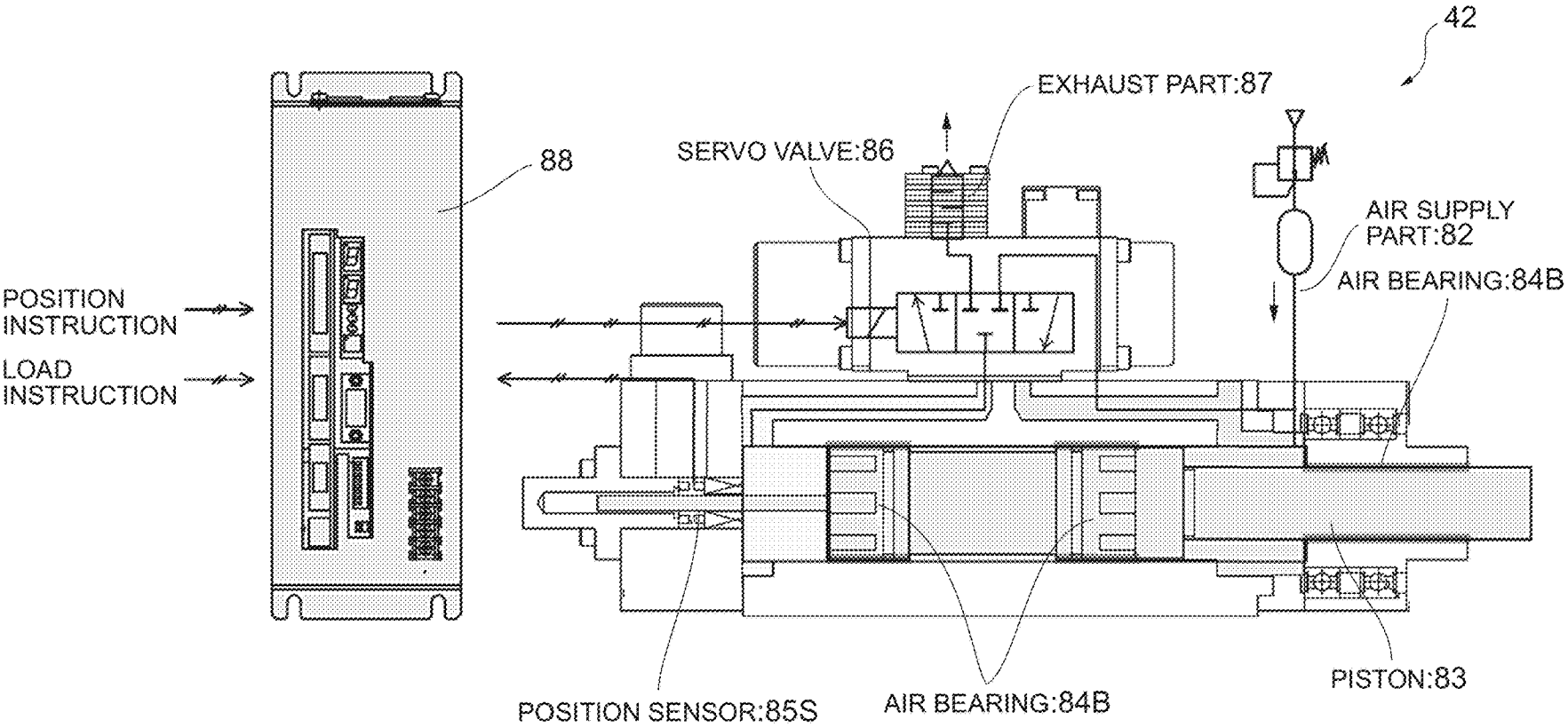
FIG. 11 is a diagram showing a configuration example of a roller mold nip device.
Figure 12:
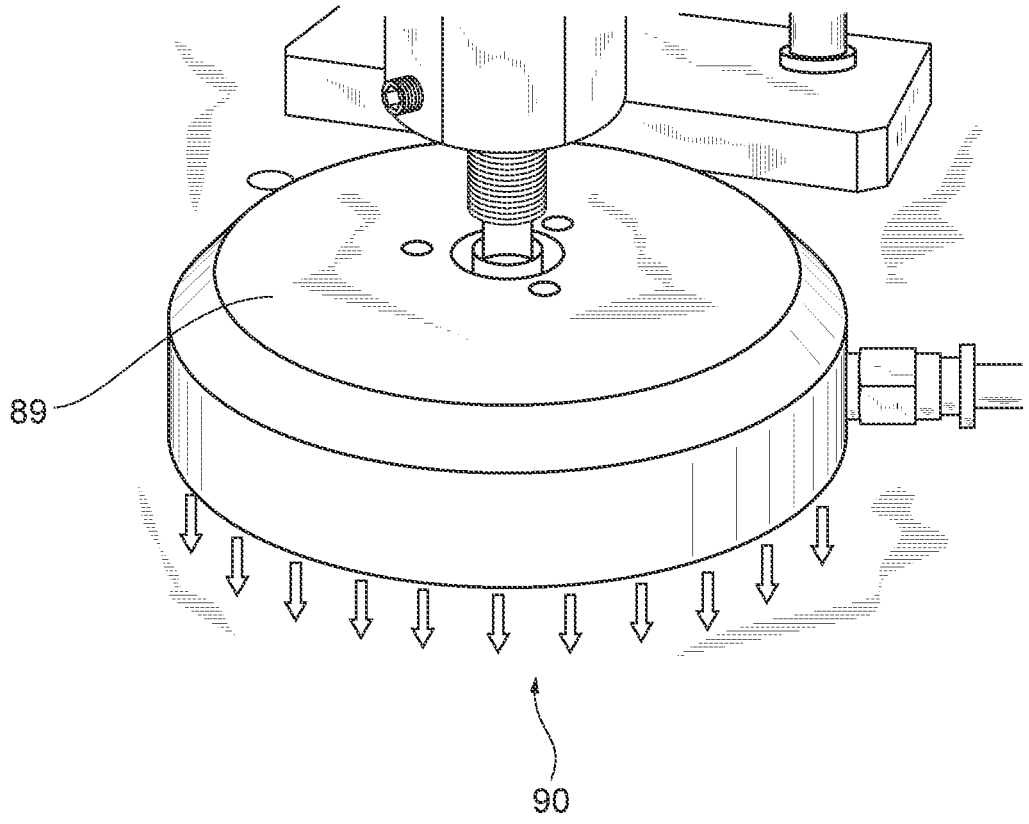
FIG. 12 is a perspective view showing an air pad.
Figure 13:
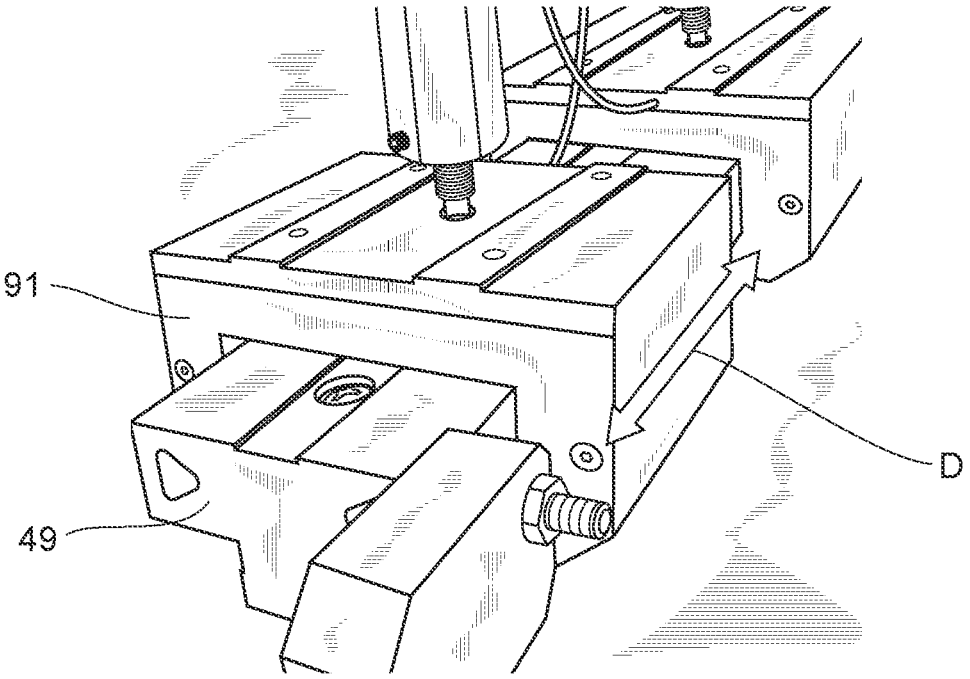
FIG. 13 is a perspective view showing a guide member and an air guide.
Figure 14:
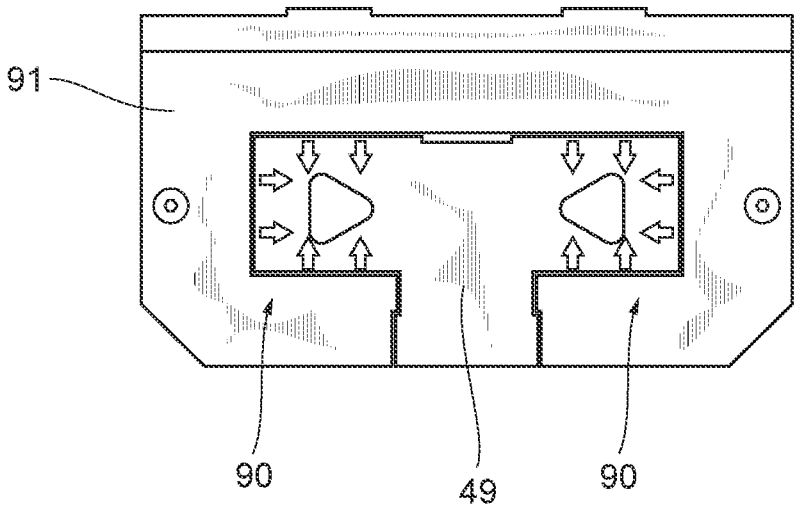
FIG. 14 is a front view showing the guide member and the air guide.

The roller mold 40 is also connected to a roller mold rotation motor 47 via a coupling 48 and driven to be rotated by the roller mold rotation motor 47 (see FIG. 8).

The roller mold cleaning member 50 strips off the ink K adhering to the roller mold 40 to clean the roller mold 40. Although the specific example of the roller mold cleaning member 50 is not particularly limited (see FIG. 1), the roller mold cleaning member 50 shown in FIG. 2 may include, for example, a cleaning film 51 and a roller 52 that presses the cleaning film 51 against the roller mold 40 (see FIG. 2). The cleaning film 51 may be formed of, for example, a polyolefin film having, on one surface thereof, a tacky acrylic pressure sensitive adhesive.

The roller mold cleaning member 50 may be provided in an integrated manner with the roller mold 40. In such case, the roller mold 40 and the roller mold cleaning member 50 may be configured so as to move together. In the present embodiment, the roller mold 40 is rotatably placed on a slider (roller mold supporting member) 44 that is provided so as to be linearly moveable on a base 46 and move to and away from the blanket cylinder 30, and the roller mold cleaning member 50 is also placed on or attached to the slider 44 (see FIG. 1). In such reverse printing device 3, since the relative positions between the roller mold cleaning member 50 and the roller mold 40 are constant regardless of the position of the slider 44, the contact pressure of the roller mold cleaning member 50 against the roller mold 40 can be easily maintained as constant.

Further, since the present embodiment employs a structure in which the roller mold 40 and the roller mold cleaning member 50 are moved with the slider 44 and the position of the axis of rotation of the blanket cylinder 30 is fixed, printing precision can be easily secured.

A roller mold nip device 42 presses the roller mold 40 against the surface of the blanket cylinder 30. The roller mold 40 is rotatably placed on the slider 44 as described above and the roller mold nip device 42 linearly moves the slider 44 toward the front side in the moving direction D (in some contexts in this specification, the side where the blanket cylinder 30 is located as viewed from the roller mold 40 will be referred to as the "front side" and the side opposite thereto will be referred to as the "rear side") to press the roller mold 40 against the surface of the blanket cylinder 30 with appropriate force (see FIG. 1). The roller mold nip device 42 functioning as described above enables ink removal control and ultra-high precision printing pressure control. Further, since the roller mold nip device 42 of the present embodiment is configured so as to control the pressing force against the slider 44 using a nip pressure (which refers to a pressure which a nip target actually receives as a result of nip operation) as a parameter, and so as to control the pressing pressure via the nip pressure rather than making the pressing force of the printing nip constant, it causes little variation in the printing pressure. It is possible to achieve ultra-high precision printing pressure control through such configuration.

The roller mold nip device 42 is configured so that its position relative to the base 46 does not change and so as to press the slider 44 via a point where force is applied from the roller mold nip device 42 to the slider 44 toward the front side (in this specification, this point will be referred to as the "force point" and denoted as "42E" in the drawings). In the roller mold nip device 42 in the roll-to-roll printing apparatus 1 of the present embodiment, the force point 42E is arranged at the same height as that of the axis of rotation of the roller mold 40. In the reverse printing device 3 having the configurations described above, the force point 42E, the axis of rotation of the roller mold 40 and a connecting region between the roller mold 40 and the blanket cylinder 30 are located in the same plane and it is possible to have a more uniform application of the nip pressure.

Further, the roller mold nip device 42 can restrict the range of motion of the roller mold 40, i.e., the range of linear motion of the slider 44. By restricting the range of linear motion of the slider 44 and the roller mold 40 as described above, the stroke width thereof is restricted and it becomes possible to bring the roller mold 40 into contact with the blanket cylinder 30 with more uniform pressure.

An impression cylinder 60 and an impression cylinder nip device 62 are devices for pressing a substrate B against the surface of the blanket cylinder 30 and are capable of performing transfer stabilizing control and ultra-high precision printing pressure control in the same way as the roller mold nip device 42 described above. The specific configuration will be described below. The impression cylinder 60 is in a roller form and placed rotatably on an impression cylinder support member 64 that is linearly moveable on a frame 66. The impression cylinder nip device 62 linearly moves the impression cylinder supporting member 64 to press the impression cylinder 60 so that the substrate B is pressed against the surface of the blanket cylinder 30 with appropriate force from the back side thereof (see FIG. 1). Although a control for making the pressing amount uniform would cause variations in pressure and affects the printing precision, the impression cylinder nip device 62 functioning as described above enables the transfer stabilizing control and the ultra-high precision printing pressure control.

Figure 1:
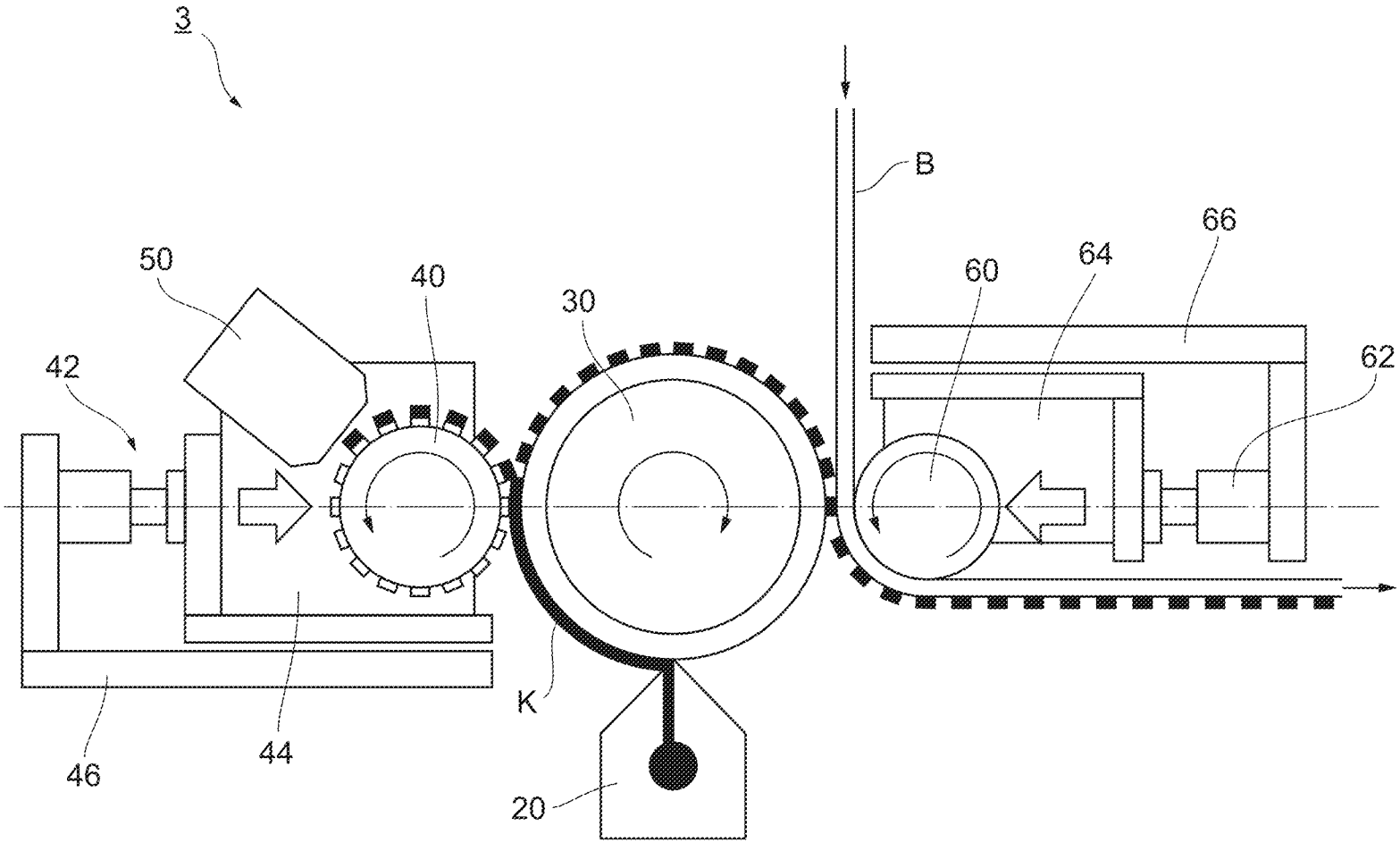
FIG. 1 is a diagram showing a configuration example of a reverse printing apparatus.

Although the arrangement of the blanket cylinder 30 and the roller mold 40 is not particularly limited, the present embodiment employs an arrangement in which the roller mold 40, the blanket cylinder 30 and the impression cylinder 60 for pressing the substrate B into contact with the blanket cylinder 30 are arranged in a linear manner on one horizontal plane so that the ink removal from the blanket cylinder 30 and the ink transfer from the blanket cylinder 30 onto the substrate B are performed on the same horizontal plane (see FIG. 1). In such arrangement, since load offset is not generated, an unnecessary bending moment is not generated in the blanket cylinder 30, the roller mold 40 and the impression cylinder 60 and the loads on the right and left sides of the blanket cylinder 30 can be easily balanced.

Next, a moving resistance reduction device 80 will be described below (see FIGS. 4 to 7). In FIGS. 4 to 7, reference numerals 53 and 54 denote rollers constituting the roller mold cleaning member 50 and reference numeral 55 denotes a motor for driving the roller 54, etc.

The moving resistance reduction device 80 is a device for reducing moving resistance of the slider 44 on the base 46. The moving resistance reduction device 80 of the present embodiment is configured to include an air blowing device 70.

The air blowing device 70 uses the air blown out therefrom to float the slider 40 from the base 44. The air blowing device 70 of the present embodiment includes air pads 89 and air blowing ports 90 and further includes air guides 91.

An air supply part 82 of the roller mold nip device 42 introduces compressed air and feeds the compressed air into a piston 83.

The compressed air supplied to the piston 83 is discharged from an exhaust part 87 via an air bearing 84B or a servo valve 86.

The air bearing 84B is a sleeve bearing (air bearing) of the piston 83, which uses the compressed air as a working fluid.

A position sensor 85S detects the position of the slider 44. The position information detected by the position sensor 85S is transmitted to a control device 88.

The servo valve 86 opens and closes in accordance with an instruction signal from the control device 88. By controlling the opening and closing of the servo valve 86, the air pressure is adjusted.

The exhaust part 87 discharges the air other than the air blown out from the air bearing 84B to the outside of the device, as appropriate.

The control device 88 controls the servo valve 86, etc. The control device 88 of the present embodiment receives the position information detected by the position sensor 85S and information related to the pressure to the roller mold 40 applied by the roller mold nip device 42 (load information) to feedback control actuators of the servo valve 86, etc. based on the received information (see FIG. 11).

The air pads 89 are members that are provided below the slider 44 and in contact with the base 46. The air pads 89 function as legs that are in contact with the base 46 except when the slider 44 is floated above the base 46 (see FIG. 8, etc.).

The air blowing port 90 is an opening through which the air is blown out from the air blowing device 70 toward the base 46. In the present embodiment, the air blowing port 90 is provided in a bottom surface of the air pad 89 so that the air is blown out from the bottom surface of the air pad 89 toward the base 46 (see FIGS. 8, 12, etc.).

The air pads 89 are preferably arranged such that the loads applied to the air pads 89 are made uniform by, for example, arranging the air pads 89 evenly with respect to the center of gravity of the weights of the slider 44, as well as, the roller mold 40 and the roller mold cleaning member 50 placed on the slider 44 (hereinafter referred to as the "center of gravity of the devices" and denoted by reference symbol C in the drawings). In the present embodiment, three air pads 89 are arranged such that the center of gravity of a triangle (isosceles triangle) formed by the three points of these air pads 89 coincides with the center of gravity C of the devices, to thereby balance and support the weights of the slider 44 and devices placed thereon in a small area formed by the air blowing ports 90 provided in the three air pads 89 (see FIG. 10).

Each air pad 89 may alternatively be arranged an equal distance from the center of gravity of the slider 44 and the devices placed on the slider 44 (i.e., the center of gravity C of the devices). Alternatively, the air blowing holes 90 may be arranged in line symmetry with respect to the axis of symmetry SA perpendicular to the moving direction D of the slider 44 (see FIG. 10).

The air guide 91 is a member that is guided by a linear guide member 49 provided on the base 46 to linearly move the slider 44 (see FIGS. 8-10, 13, etc.). In the present embodiment, the guide member 49, having a T-shape in cross section, guides the air guide 91, having a channel-like shape in cross section, and covers the guide member 49 to linearly move the slider 44.

The guide member 49 is provided to guide the slider 44 only in a direction which causes the roller mold 40 to move to and away from the blanket cylinder 30. The guide member 49 of the present embodiment guides the slider 44 in the direction perpendicular to the axis of rotation of the blanket cylinder 30 (see FIGS. 9, 10, etc.).

The air guide 91 may be provided with the air blowing port 90. In the present embodiment, the air blowing port 90 is provided in an inner surface of the air guide 91 so as to blow the air toward the inner side of the air guide 91 (see FIGS. 8 and 14). The direction of the air blown out from the air blowing port 90 is not particularly limited and the air blowing port 90 is only required to be provided so as to blow the air toward an inner space of the air guide 91 (see FIG. 14). The air blown out toward the inner space of the air guide 91 floats the slider 44, etc. with its pressure. The air blown out from the air blowing port 90 leaks out from between the air guide 91 and the guide member 49 (see FIG. 14, etc.).

The roll-to-roll printing apparatus 1 including the moving resistance reduction device 80 having the configuration described above can minimize the moving resistance of the slider 44 on the base 46, i.e., the friction resistance during the movement of the slider 44. With such configuration, the printing apparatus is capable of: easily absorbing fluctuations in the pressure and position; exhibiting excellent following capability; and easily reducing variations in the pressing force of the printing nip of the roller mold 40 (in one example, variations in the pressing force can be reduced to 0.02 N or less, although the reduction level depends on the design, etc. of devices). Thus, it is possible to bring the roller mold 40 into uniform contact with the blanket cylinder 30 and make the pressure uniform. In addition, such printing apparatus can eliminate the need for an operation for managing the pressing amount of the printing nip which has been required in conventional printing apparatuses.

Although the above embodiment is an example of a preferred embodiment of the invention, the invention is not limited thereto and various modifications may be made without departing from the gist of the invention. For example, although the moving resistance reduction device 80 includes the air blowing device 70 (having the air pads 89, air blowing ports 90 and air guides 91) and has the configuration of reducing the resistance during movement of the slider 44 using the air in the above embodiment, it is obvious that such configuration is merely a preferred example and the resistance during movement of the slider 44 may be reduced by other configurations. For example, the moving resistance reduction device 80 may be formed using a rolling element with a small rolling resistance, such as a ball screw and a roller, to reduce the friction resistance.

Although three air pads 89 are provided in the above embodiment, such configuration is merely a preferred example and four or more air pads 89 may instead be provided.

Although the printing apparatus according to the invention is applied to the apparatus having the reverse printing device 3 in the above embodiment, such configuration is merely a preferred example and the invention may also be applied to, for example, a printing apparatus (other than a reverse printing apparatus) including rolls, in which the nip pressures of the rolls are desired to be made uniform.

Example 1

The inventors set a target value for each of the moving resistance of the slider 44 and the variations in the printing pressure, experimentally produced a roll-to-roll printing apparatus having a moving resistance reduction device 80 to measure actual values (resulting values) for the respective items and compared the resulting values with the relevant values of a conventional printing apparatus (hereinafter referred to as the "commercial NIP") (see FIG. 15, etc.).

Figure 16A:
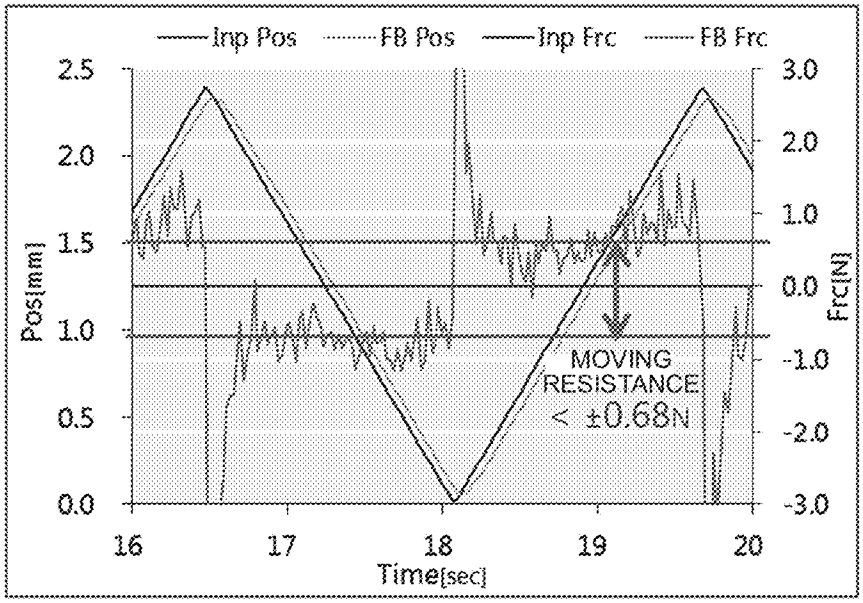
FIG. 16A is a graph showing a moving resistance of a roller mold moving device in a conventional printing apparatus (commercial NIP)
Figure 16B:
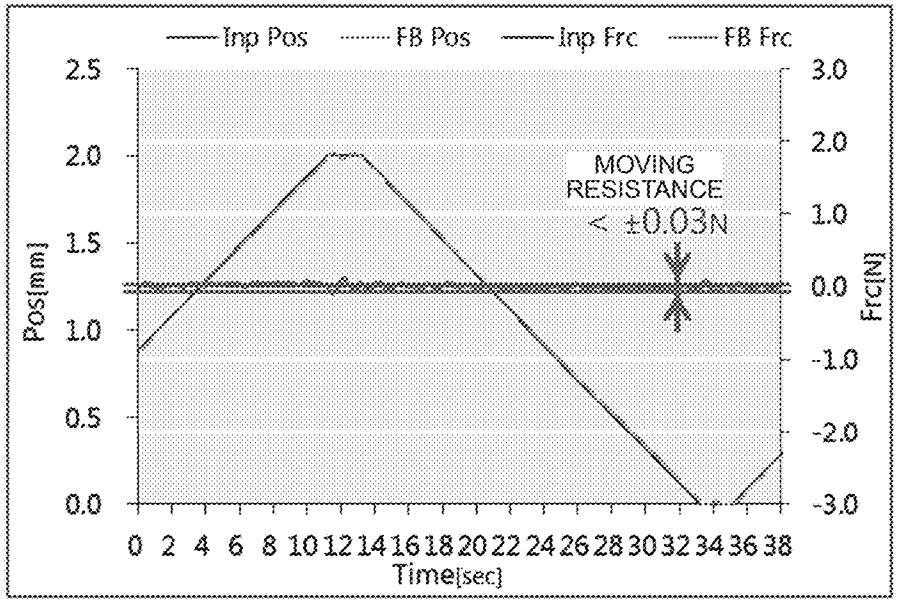
FIG. 16B is a graph showing a moving resistance of a slider in a printing apparatus according to an Example of the invention.

In a commercial NIP having a contact-type guide, the moving resistance of a device for moving a roller mold was 0.68 [N], whereas the moving resistance of the slider 44 of the roll-to-roll printing apparatus 1 in this example was 0.03 [N] (see FIG. 16). This result indicated that, based on the calculation of (0.03−0.68)/0.68, the moving resistance of this Example was reduced by 95% relative to that of the commercial NIP. The moving resistance of 0.03 [N] means that the slider 44 can be moved by the force of three 1-yen coins (3 g) and such small resistance enables ultra-high precision printing pressure control.

Figure 17:
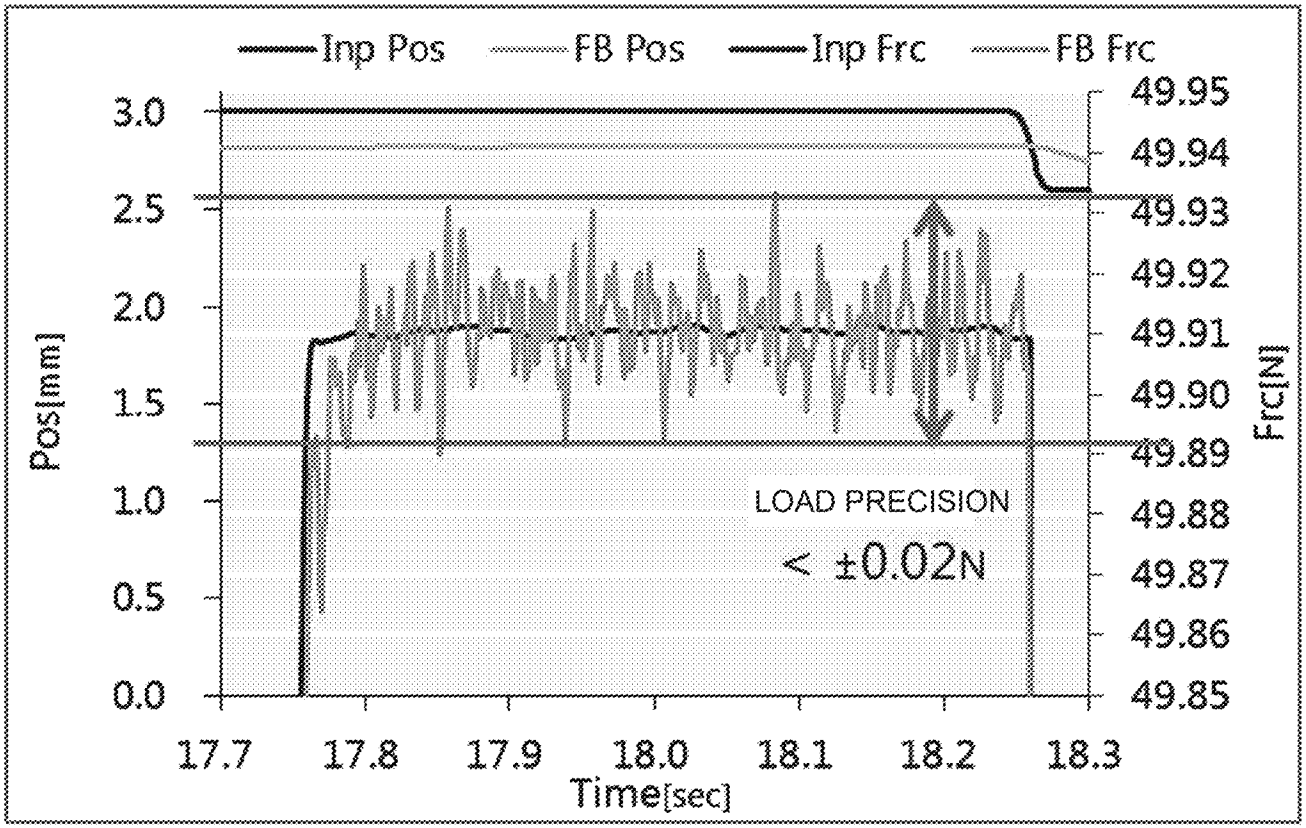
FIG. 17 is a graph showing variations in a printing pressure of the printing apparatus according to an Example of the invention.

Load precision (the variation range of load relative to a preset load) was measured under a preset load of 50 [N] and a pressing time of 0.5 [sec] and the result was 0.02 [N] or less (see FIG. 17). This result indicated that, based on the calculation of 0.02/50, the variation in the printing pressure was 0.04%. The terms shown in FIGS. 16 and 17 are defined as follows: InP Pos means "position instruction," FB Pos means "position feedback," Inp Frc means "load instruction" and FB Frc means "load feedback."

The above results verified that the roll-to-roll printing apparatus 1 according to this Example achieved moving resistance and variation in the printing pressure which were much smaller than the respective target values (see FIG. 15). In addition, the above results verified that the roll-to-roll printing apparatus 1 according to this Example could achieve an ultra-high precision printing pressure control technique which is much greater than that of the commercial NIP.

Second Embodiment

A reverse printing device 3 is one of the devices which constitutes a roll-to-roll printing apparatus 1 and it performs seamless reverse printing onto a substrate B. The following description will first describe the outline of the roll-to-roll printing apparatus 1 and then describe the reverse printing device 3.

The reverse printing device 3 performs printing on the substrate B. The reverse printing device 3 of the present embodiment includes an ink supply member 20, a blanket cylinder 30, a roller mold 40 and a roller mold cleaning member 50 (see FIG. 1) and further includes an impression cylinder 60, a print distortion detecting camera 71 and so on (see FIG. 2).

The blanket cylinder 30 has a metallic roll as its core and a layer of a soft and easily-deformable material, such as PDMS (polydimethylsiloxane), on its outermost surface. Since PDMS absorbs a solvent in the reverse printing ink, it brings the ink in a semi-dried state, which is close to a solid state, in a short time, and it can remove the ink according to a pattern without causing the ink to be crushed and spread. Further, since PDMS is a material used for making a mother die used for producing replicas in the industry and has excellent mold release characteristics, it has an advantage in which the transfer from PDMS onto films can be performed easily.

The roller mold 40 is a member for removing part of the ink applied on the surface of the blanket cylinder 30 according to a pattern (pattern removal). The roller mold 40 of the present embodiment is brought into contact with the surface of the blanket cylinder 30 while being rotated in a direction reverse to the rotation of the blanket cylinder 30, to remove unnecessary portions of the ink (see FIG. 1).

Figure 2:
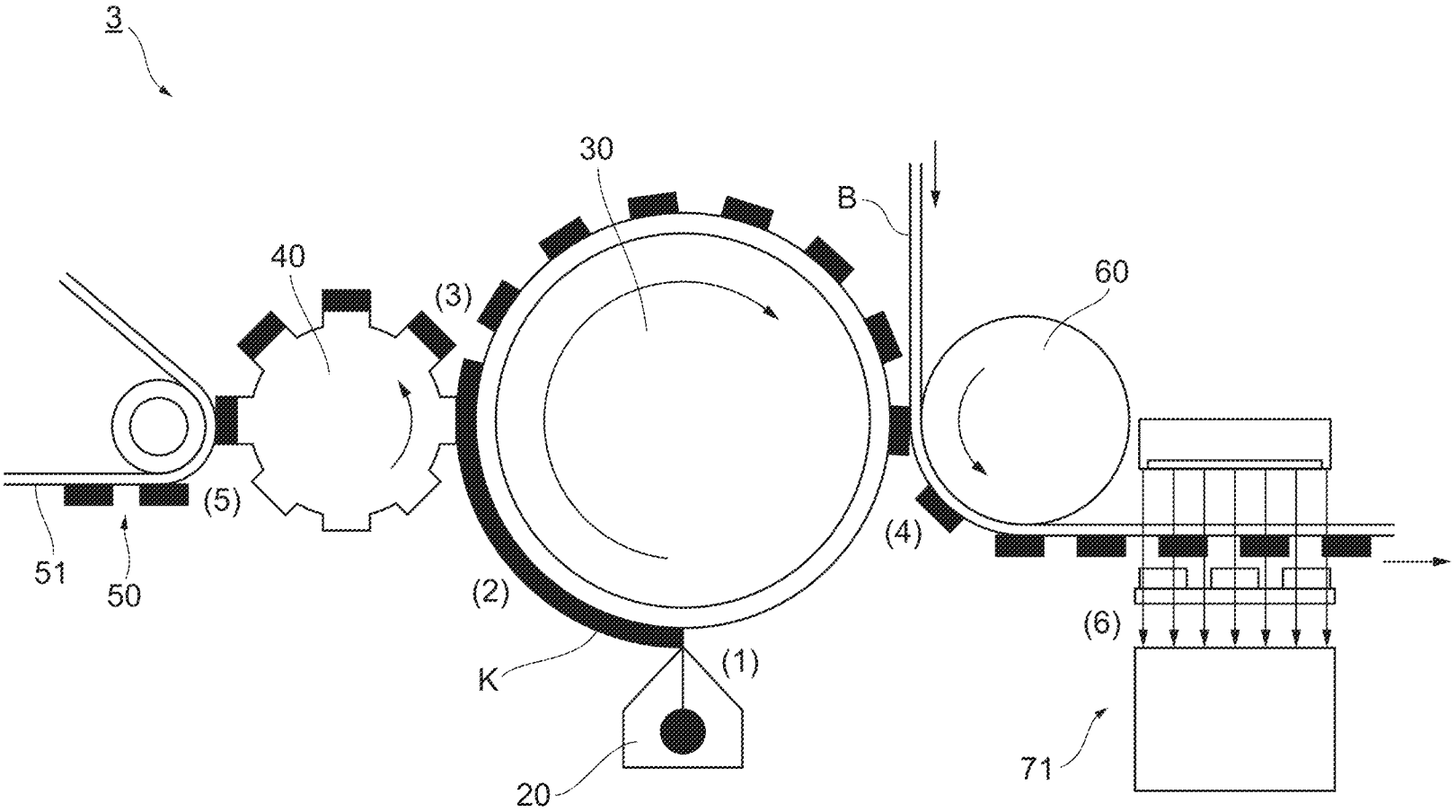
FIG. 2 is a partially-enlarged view of a printing apparatus, showing a roller mold cleaning member constituted by a cleaning film.

Next, the outline of printing steps by the reverse printing device 3 will be described below (see FIG. 2). The numbers in the parentheses below correspond to the numbers in FIG. 2.

(1) The ink is supplied from the ink supply member 20 to coat the surface of the blanket cylinder 30.

(2) A film of the coated ink is semi-dried.

(3) Non-printing portions of the semi-dried ink are removed by the roller mold 40.

(4) Printing portions remaining on the blanket cylinder are transferred to the substrate B.

(5) The roller mold 40 is dry-cleaned using, for example, a cleaning film 51.

(6) Distortion in lines printed on the substrate B is detected using the print distortion detecting camera 71 based on moiré fringes.

In the reverse printing device 3 of the present embodiment, part of the ink K applied on the surface of the blanket cylinder 30 is removed by the roller mold 40 and the remaining part of the ink K is transferred to the substrate B, as described above. Since the roller mold 40 is a printing plate (seamless roller mold) with seamless pattern or with almost seamless pattern (specifically, a gap between the pattern seams is 1 μm or less) and the blanket cylinder 30 functions as a seamless blanket cylinder (seamless blanket roller) that transfers the ink K while being rotated, seamless printing can be continuously performed on the substrate B by a so-called roll-to-roll method. With such configuration, the size of the substrate is not restricted in terms of the traveling direction thereof and a printed product having a large area according to the width of the reverse printing device 3 can be produced.

Further, since the reverse printing device 3 performs reverse printing while the ink K adhering to the roller mold 40 is stripped off by the roller mold cleaning member 50, it is possible to continuously perform the reverse printing while the function of removing part of the ink K by the roller mold 40 is maintained.

In addition, in the reverse printing device 3, by adjusting the pressure using the functions of the roller mold nip device 42, the impression cylinder nip device 62, and others, it is possible to perform continuous printing with the blanket cylinder 30 being in contact with the substrate B with a constant pressure.

Third Embodiment

In recent years, developments have been made in techniques for manufacturing electronic devices using printing processes. Among such techniques, a reverse (reverse offset) printing method, which is a technique for printing electronic devices with a high resolution of, for example, 10 microns or less, has been studied and developments of printing apparatuses have been promoted. As one of such printing apparatuses, a roll-to-roll printing apparatus has been proposed, which performs seamless reverse printing on a substrate using a roll-to-roll method. Among such roll-to-roll printing apparatuses, a printing apparatus has also been proposed which includes a plurality of reverse printing units to perform overlay printing (multilayer printing).

An alignment model (i.e. a model that takes into consideration an error in overlay printing performed by a plurality of printing units) depends on a difference between a component affected by a tension fluctuation in a previous printing unit after a time required for the substrate to reach the next printing unit and a component affected by a tension fluctuation in such next printing unit. The roll-to-roll apparatus that performs overlay printing using the plurality of printing units needs a control technique for reducing a difference (alignment error) between a print position in a printing unit of interest and a print position in a printing unit immediately before the printing unit of interest.

Examples of actual alignment control methods for roll-to-roll printing apparatuses includes: a compensator-less method in which alignment control is performed by controlling a tension between two drive rolls based on a difference between their rotary speeds; and a compensator roll method in which alignment control is performed by placing a dancer roll actuator between drive rolls rotating at the same speed to control a path line length to thereby control the tension between the rolls. In both the methods, although the relationship between the tension fluctuation and alignment precision is modeled and the alignment control is performed by feedback control, feedforward control is employed in order to cancel out the effect of the operation of a previous unit by the operation amount of the next unit, in order to maintain the alignment precision in the next unit (see, for example, JP2008-055707 A, JP2010-094947 A and JP2002-248743 A).

However, in the compensator-less method, since the actuator that can be operated is a drive roll that has a large inertia, there are limitations in performing fine control. On the other hand, in the compensator roll method, since the operation range is limited and the tension fluctuation that can be handled is therefore limited, the device has to be designed so as to be capable of reducing potential tension fluctuations, which causes the inertia to be increased and the actuator precision to be degraded, thereby resulting in failure to achieve a desired printing environment and a desired alignment precision.

In view of the above problems, the roll-to-roll printing apparatus to be described below is capable of improving the alignment precision in overlay printing by finely controlling the tension of a substrate. The following description will first describe [A. Roll-to-roll printing apparatus for single-layer printing] (see FIG. 18, etc.) and then describe [B. Roll-to-roll printing apparatus capable of performing multilayer printing (overlay printing)] (see FIG. 22, etc.).

[A. Roll-to-Roll Printing Apparatus for Single-Layer Printing]

Figure 18:
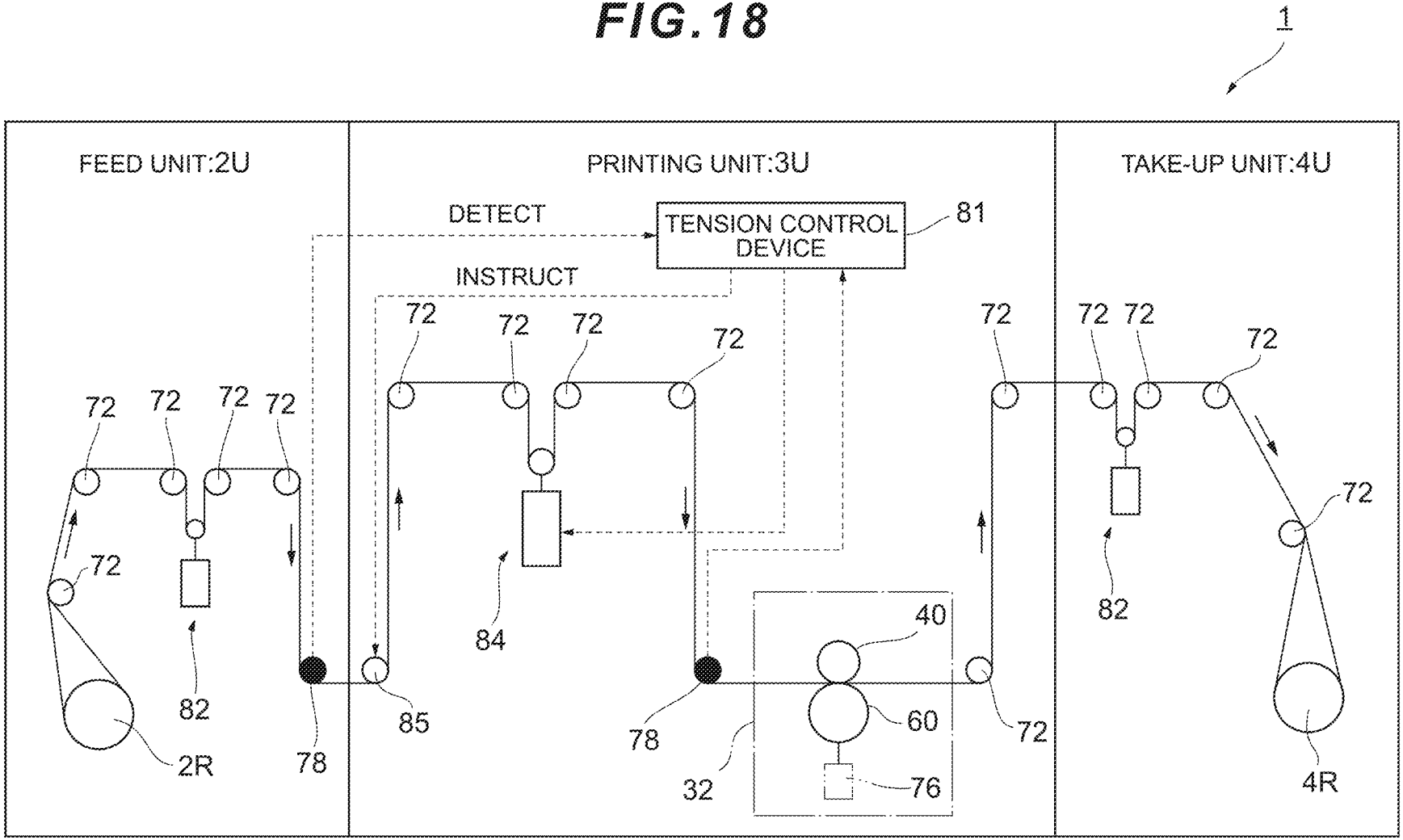
FIG. 18 is a diagram showing an outline of devices constituting a roll-to-roll printing apparatus and a conveyance path for conveying a substrate (film).

A roll-to-roll printing apparatus 1 includes a feed unit 2U, a printing unit 3U, a take-up unit 4U, etc., and performs seamless printing on a substrate B using a roll-to-roll method (see FIG. 18). In the roll-to-roll printing apparatus 1, a rolled substrate B is first fed by the feed unit 2U, conveyed by a conveyance device constituted by free rolls 72, an in-feed roll 85 serving as a drive roll (hereinafter simply referred to as the "drive roll"), etc., to the printing unit 3U where the substrate B is subjected to printing, and is then conveyed to the take-up unit 4U where the substrate B is taken up into a roll.

The substrate B may be formed of, for example, a flexible film, a surface of which is subjected to printing by the printing unit 3U. The substrate B is initially in a rolled shape, which is then fed by the feed unit 2U from the rolled shape and sent along a predetermined path (see the arrows in FIG. 18) into a printing step where an ink pattern is transferred onto the substrate B by the printing unit 3U. After the printing step, the substrate B is subjected to steps, such as a drying step (not shown), and taken up into a roll by the take-up unit 4U.

The printing in the printing unit 3U is performed using a roller mold 40 (hereinafter also referred to as the "roller mold roll") and an impression cylinder (hereinafter also referred to as the "impression cylinder roll") 60, etc. in a printing part 32. The impression cylinder roll 60 is driven by a drive roll actuator (hereinafter also referred to as the "impression cylinder actuator") 76 (see FIG. 18).

The feed unit 2U feeds the substrate B which has been formed in a rolled shape in advance (see FIG. 18). The take-up unit 4U takes up the substrate B on which printing has been performed by the printing unit 3U (see FIG. 18).

The printing unit 3U is one of the devices which constitutes the roll-to-roll apparatus 1 and it performs seamless printing on the substrate B.

The roll-to-roll printing apparatus 1 of the present embodiment includes, in addition to the configurations above, the free rolls 72, the in-feed roll 85, the impression cylinder roll 60, the roller mold roll 40, tension sensor 78*s*, a tension control device 81, dancer rolls 92, a dancer roll actuator 84, etc. to feed and take-up the substrate B and reduce the tension fluctuation by controlling the tension of the substrate B.

The free rolls 72 are arranged on a passage of the substrate B from the feed unit 2U via the printing unit 3U to the take-up unit 4U and rotated as the substrate B is conveyed.

The in-feed roll 85 is a roller that applies conveyance force to the substrate B (i.e., a drive roll) and the in-feed roller 85 is driven so as to be rotated by a drive roll actuator constituted by a motor, etc.

The tension sensor 78 detects the tension of the substrate B at a predetermined position (see FIG. 18). In one example, in the roll-to-roll printing apparatus 1 of the present embodiment, the tension sensor 78 is arranged at the last part in the feed unit 2U and before the printing part 32 of the printing unit 3U in order to detect the tension of the substrate B at the respective positions, and transmits the detected data to the tension control device 81.

The tension control device 81 may be constituted by, for example, a programmable drive system and the tension control device 81 receives a detection signal from the tension sensor 78 and controls the in-feed roll 85 and the dancer roll actuator 84 in accordance with the detection result (see FIG. 18).

The dancer roll 92 is a device for applying a constant load on the substrate B. The dancer roll 92 of the present embodiment applies a predetermined load according to a suspended weight onto the substrate B via rollers (see FIG. 18). It should be noted that the dancer roll 92 used in the roll-to-roll printing apparatus 1 of the present embodiment 1 is a known device that does not have a detector for detecting the position of the dancer roll itself in its range of movement or an actuator for driving the dancer roll itself.

The dancer roll actuator 84 has a mass and an inertia which are much smaller than those of the dancer roll 92 and therefore has an excellent sensitivity and following capability, and the dancer roll actuator 84 is capable of rapidly operating to control the tension of the substrate B with ultra-high precision. In the present embodiment, the dancer roll actuator 84 serves as a tension control actuator, rather than serving simply as a dancer roll. Specifically, for a tension fluctuation in a predetermined low-frequency band, the drive roll 85 is controlled so as to cancel out such tension fluctuation, whereas for a tension fluctuation in a predetermined high-frequency band, the dancer roll actuator 84 is controlled so as to cancel out such tension fluctuation.

<Regarding Compensator-Less Method and Compensator Roll Method in Printing Apparatus>

A typical printing control method used in a photogravure printing apparatus or the like is intended to change the adjustment amount by appropriately adjusting an actuator to control a desired control amount in a desired way. The control target is non-linear; however, an actual control system is designed by taking into consideration the computation load and the range within which the target is moved and performing linear approximation around a certain steady state. The steady state refers to a balanced state with a certain control amount applied to each actuator. In both the compensator-less method and the compensator roll method, such steady state is used as a base, modeling is obtained based on the mechanisms and phenomena which occur, with respect to the objective of how the alignment error can be reduced, and control inputs (i.e. how to move the actuator) that achieve the objective are determined.

When moving the actuator, the amounts of its movements are naturally handled as "variables." By moving the actuator, the "variable" is changed and consequently the "desired control amount" is changed.

TABLE 1

| Method | Desired control amount | Adjustment amount | Variable |
|---|---|---|---|
| Compensator-less method | Registration error | Rotary speed of gravure cylinder | Tension |
| Compensator roll method | Registration error | Moving speed of compensator roll | Tension and distance between rolls |

<Tension Control Model Using Dancer Roll Actuator>

Tension control model using the dancer roll actuator 84 will now be described below.

(1) The tension fluctuations in the respective units 2U, 3U and 4U are determined by the drive rolls located before and after the relevant unit (the impression cylinder roll 60 and the roller mold roll 40), the speed change of the free roll 72, the effect of tension fluctuation in the previous stage, and the position change of the dancer roll existing in the relevant unit.

(1)-2 Since the tension fluctuation in each of the units 2U, 3U and 4U depends on the speed change of the drive rolls located before and after the relevant unit, the operation performed for controlling a tension in the previous stage will necessarily affect the tension in the next stage. Accordingly, feed-forward control is needed in order to cancel out the effect from the previous stage in the next stage.

(2) In the printing unit 3U, the operation amount serves as a speed change instruction to the drive roll and a load instruction to the dancer roll actuator 84. Since keeping a constant load to the dancer roll actuator 84 and changing the load to the dancer roll actuator 84 to keep a constant position thereof are inextricably linked to each other (i.e., the position of the dancer roll actuator 84 has to be changed and adjusted in order to maintain a constant load thereto, whereas the load to the dancer roll actuator 84 has to be changed and adjusted in order to maintain a constant position, and it is physically impossible to achieve both constant load and constant position at the same time; in other words, either the position or the load has to be selected in designing the control system), it is possible to employ its position as a position instruction (i.e. control the position of the dancer roll in accordance with instructions).

(3) In the tension fluctuation model in each unit, the speed (time constant) of the effects of operations of the drive rolls (a feed roll 2R, the drive roll 85, the roller mold roll 40, the impression cylinder roll 60 and a take-up roll 4R) and the dancer roll actuator 84 changes depending on a line speed (represented by "r*ω*" (the product of the radius r* and the angular speed ω*) in the unit models indicated below). The magnitude (gain) of the effects of operations changes depending on the Young's modulus and a preset tension of the substrate B.

<Tension Control Model>

Equations (equations 1 to 11) representing models for controlling the tension of the substrate B in the roll-to-roll printing apparatus 1 will be described below. Equations 1 to 4 represent general-purpose models, equations 5 and 6 represent models for the feed unit 2U, equations 7 and 8 represent models for the printing unit 3U, and equations 9 to 11 represent models for the take-up unit 4U. These equations are models of input-output relationships based on physical equations.

$$L_{i0}\frac{d\Delta T_i(t)}{dt} = r_i^*\omega_i^*(-\Delta T_i(t)+\Delta T_{i-1}(t)) + 2(AE-T_i^*)y_i(t)+(AE-T_i^*)(r_{i+1}^*\Delta\omega_{i+1}(t)-r_i^*\Delta\omega_i(t)) \quad \text{[Equation 1]}$$

$$\dot{y}_i(t) = -\frac{D_i}{M_i}y_i(t)+\frac{2}{Mi}\Delta T_i(t) \quad \text{[Equation 2]}$$

$$\frac{de_{j,i}(t)}{dt} = \frac{r_i^*\omega_i^*}{AE}(-\Delta T_{j,i}(t)+\Delta T_{j-1,i}(t-L)) \quad \text{[Equation 3]}$$

$$\epsilon_i(t) = \epsilon_p^*\frac{L_{i0}}{AE\Delta L_i}\Delta T_i(t)+\Delta\epsilon_p(t) \quad \text{[Equation 4]}$$

$$L_{10}\frac{d\Delta T_1(t)}{dt} = r_1^*\omega_1^*(-\Delta T_1(t)+\Delta T_0(t)) + (AE-T_1^*)(2y_1(t)+(r_2^*\Delta\omega_2(t)-r_i^*\Delta\omega_1(t))) \quad \text{[Equation 5]}$$

$$\dot{y}_1(t) = -\frac{D_1}{M_1}y_1(t)+\frac{2}{M_1}\Delta T_1(t) \quad \text{[Equation 6]}$$

$$\dot{x}_1(t) = y_1(t)$$

$$L_{20}\frac{d\Delta T_2(t)}{dt} = r_2^*\omega_2^*(-\Delta T_2(t)+\Delta T_1(t)) + (AE-T_2^*)(2y_2(t)+(r_3^*\Delta\omega_3(t)-r_2^*\Delta\omega_2(t))) \quad \text{[Equation 7]}$$

$$\dot{y}_2(t) = -\frac{D_2}{M_2}y_2(t)+\frac{2}{M_2}(\Delta T_2(t)+f_2(t)) \quad \text{[Equation 8]}$$

$$\dot{x}_2(t) = y_2(t)$$

$$L_{30}\frac{d\Delta T_3(t)}{dt} = r_3^*\omega_3^*(-\Delta T_3(t)+\Delta T_2(t)) + (AE-T_3^*)(2y_3(t)+(r_4^*\Delta\omega_4(t)-r_3^*\Delta\omega_3(t))) \quad \text{[Equation 9]}$$

$$\dot{y}_3(t) = -\frac{D_3}{M_3}y_3(t)+\frac{2}{M_3}\Delta T_3(t) \quad \text{[Equation 10]}$$

$$\dot{x}_3(t) = y_3(t) \quad \text{[Equation 11]}$$

Each symbol in Equations 1 to 11 is defined as indicated in Table 2 below.

TABLE 2

| | |
|---|---|
| $r_i$ | Radius of the i-th roll |
| $\omega_i$ | Angular speed of the i-th roll |
| $y_i$ | Moving speed of the i-th dancer roll |
| $x_i$ | Position of the i-th dancer roll |
| $T_i$ | Tension fluctuation in the i-th zone |
| $\Delta\omega_i$ | Control input relative to the equilibrium state of the i-th roll |
| $\Delta T_i$ | Tension fluctuation from the equilibrium state in the i-th zone |
| $L_{i0}$ | Substrate length under no tension in the i-th zone |
| $\Delta L_i$ | Change from the substrate length under a reference tension in the i-th zone |
| $D_i$, $M_i$ | Coefficient representing dynamic characteristics of the i-th dancer roll |
| $e_i$ | Alignment error (registration error) in the i-th unit |
| $\epsilon_i$ | Relative distortion in the i-th unit |
| $\epsilon_p$* | Distortion coefficient |
| $\Delta\epsilon_p$ | Additive distortion, assuming fluctuations by the NIP pressure, etc. in the reverse printing part |
| $f_i$ | Load instruction in the case when the i-th dancer roll is an actuator dancer roll |
| A | Cross-sectional area of the substrate |
| E | Young's modulus |
| L | Dead time determined by the substrate length at the alignment position (print position) and conveyance speed (An alignment error is affected by the tension fluctuation; since the alignment error is a deviation relative to the print position in the previous stage, there is a time lag until the effect from the previous stage is exerted.) |
| r(t) | Target reference input |
| d(t) | Disturbance signal |

Next, the following description will describe the content of a precision improving technique for the tension control in the roll-to-roll printing apparatus 1 that includes the dancer roll actuator 84 according to the present embodiment by presenting three specific examples.

<First Precision Improving Technique>

Figure 19:
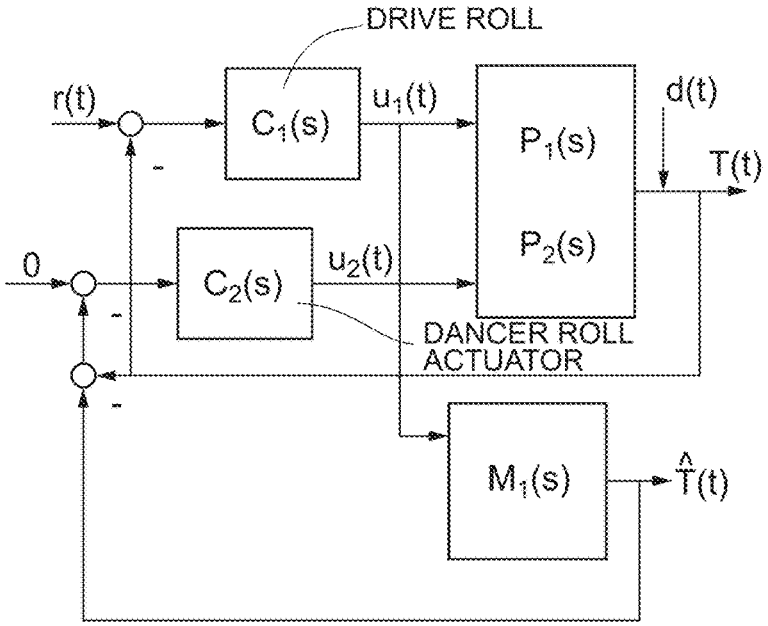
FIG. 19 is a diagram showing a control model in a first precision improving technique of a tension control in a roll-to-roll printing apparatus.

A basic strategy of the control model shown in FIG. 19 is to separate a control specification for the drive roll 85 and a control specification for the dancer roll actuator 84 from each other.

The reference symbols in FIG. 19 respectively represents the following content:

P1(s): Transfer function representing a behavior from the drive roll to the tension (actual control target)

P2(s): Transfer function representing a behavior from the dancer roll actuator to the tension (actual control target)

C1(s): Controller calculating the operation amount of the drive roll

C2(s): Controller calculating the operation amount of the dancer roll actuator

M1(s): Model of the P1(s) portion

This control model is suitable for considering a configuration for causing the motion of C2(s) to provide a fine adjustment around the result of control by C1(s). Further, this control model is capable of correcting tension fluctuations, including an effect from a modelling error, using the C2(s) system.

The closed-loop transfer functions in the above control model will now be indicated in Equations 12 and 13 below.

$$y(t) = \frac{P_1C_1+P_2C_2M_1C_1}{I+P_1C_1+P_2C_2(I+M_1+C_1)}r(t) + \frac{1}{I+P_1C_1+P_2C_2(I+M_1C_1)}d(t) \quad \text{[Equation 12]}$$

[Equation 13]

Where there is no modeling error, $$(M_1(s) = P_1(s)) \quad \text{[Equation 13]}$$

$$y(t) \rightarrow \frac{P_1C_1}{I + P_1C_1}r(t) + \frac{1}{(I + P_1C_1)(I + P_2C_2)}d(t)$$

As described above in relation to the linear approximation model, the tension fluctuation in each unit is affected by the drive rolls before and after the relevant unit. In the first precision improving technique, basically, the tension control for the printing unit 3U is performed by operating the drive roll 85 located before the printing unit 3U, and the tension control for the feed unit 2U and the take-up unit 4U is performed by operating the feed roll 2R and the take-up roll 4R, respectively. In other words, the drive roll 85 used for the control in one unit, on its own, reduces interference of the control itself. In the printing unit 3U, the tension control is performed by controlling the rotary speed of the drive roll 85 or controlling the load (or position) of the dancer roll actuator 84. In the feed unit 2U and the take-up unit 4U, the tension control is indirectly performed by controlling the position of the dancer roll (this is because the position of the dancer roll varies when there is unevenness in the tension and stops when such unevenness is removed).

In the printing unit 3U, there are two operation amounts, i.e., the operation amount of the drive roll 85 and the operation amount of the dancer roll actuator 84. The drive roll 85 having a large inertia constitutes a rough tension feed-back control system of the printing unit 3U and compensates for a basic stability (which means, in this specification, that a tension control system (C1 system) formed by the drive roll 85 constitutes a basic tension control system and achieves a certain level of performance). Such tension feedback control system is designed based on M1, being a model of P1. Although P1 and M1 ideally coincide with each other, there is actually a deviation (which is referred to as the "modelling error") therebetween. In order to compensate for such modelling error, the dancer roll actuator is used (see reference symbol $u_2$ in FIG. 19) to compensate for the deviation in the control performance resulting from the modeling error and also to alleviate the effect of disturbance on the tension fluctuation.

<Second Precision Improving Technique>

Figure 20:
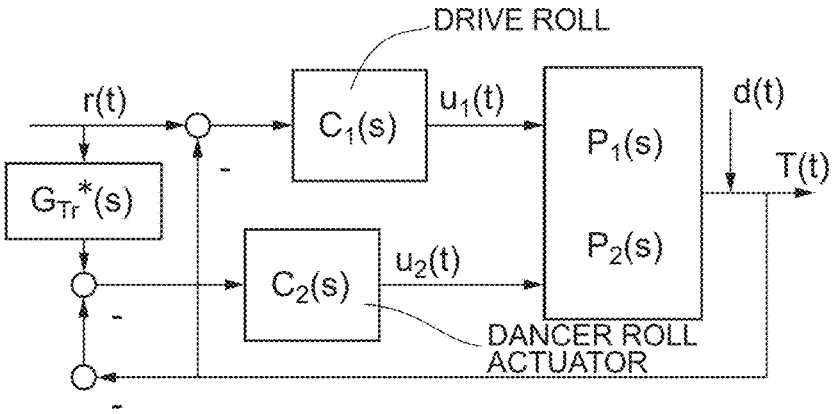
FIG. 20 is a diagram showing a control model in a second precision improving technique of the tension control in the roll-to-roll printing apparatus.

A basic strategy of the control model shown in FIG. 20 is to separate a control specification for the drive roll 85 and a control specification for the dancer roll actuator 84 from each other.

The reference symbols in FIG. 20 respectively represents the following content:

P1(s): Transfer function representing a behavior from the drive roll to the tension (actual control target)

P2(s): Transfer function representing a behavior from the dancer roll actuator to the tension (actual control target)

C1(s): Controller calculating the operation amount of the drive roll

C2(s): Controller calculating the operation amount of the dancer roll actuator

GTr*(s): Ideal response of a closed-loop system constituted by C1(s)

This control model is suitable for considering a configuration for causing the motion of C2(s) to provide a fine adjustment around the result of control by C1(s). Further, this control model is capable of correcting deviation from a desired motion of the C1(s) system using the C2(s) system.

The closed-loop transfer functions in the above control model will now be indicated in Equations 14 to 16 below.

$$G^*_{Tr}(s) = \frac{P_1C_1^*}{I + P_1C_1^*} \quad \text{[Equation 14]}$$

$$y(t) = \frac{P_1C_1(I + P_1C_1^*) + P_2C_2P_1C_1^*}{(I + P_1C_1 + P_2C_2)(I + P_1C_1^*)}r(t) + \frac{1}{I + P_1C_1 + P_2C_2}d(t) \quad \text{[Equation 15]}$$

[Equation 16]

Where the C1 system provides an ideal response, $$(C_1(s) = C_1^*(s)) \quad \text{[Equation 16]}$$

$$y(t) \rightarrow \frac{P_1C_1^*}{I + P_1C_1^*}r(t) + \frac{1}{I + P_1C_1^* + P_2C_2}d(t)$$

As described above in relation to the linear approximation model, the tension fluctuation in each unit is affected by the drive rolls before and after the relevant unit (the in-feed roll 85, the impression cylinder roll 60 and the roller mold roll 40). In the second precision improving technique, basically, the tension control for the printing unit 3U is performed by operating the drive roll 85 located before the printing unit 3U, and the tension control for the feed unit 2U and the take-up unit 4U is performed by operating the feed roll 2R and the take-up roll 4R, respectively. In other words, the drive roll used for the control in one unit, on its own, reduces interference of the control itself.

In the printing unit 3U, there are two operation amounts, i.e., the operation amount of the drive roll and the operation amount of the dancer roll actuator 84. The drive roll having a large inertia constitutes a rough tension feed-back control system of the printing unit 3U and compensates for a basic stability. Such tension feedback control system is designed based on M1, being a model of P1. Although P1 and M1 ideally coincide with each other, there is actually a deviation (which is referred to as the "modelling error") therebetween. Such modeling error causes a divergence between the ideal response GTr which specifies a desired motion and the actual motion. In order to eliminate such divergence, the dancer roll actuator is used (see reference symbol $u_2$ in FIG. 20) to compensate for the deviation from the ideal response resulting from the modeling error and also to alleviate the effect of disturbance.

<Third Precision Improving Technique>

Figure 21:
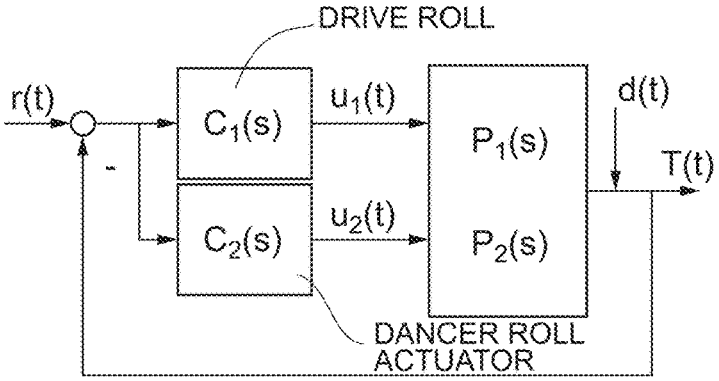
FIG. 21 is a diagram showing a control model in a third precision improving technique of the tension control in the roll-to-roll printing apparatus.

A basic strategy of the control model shown in FIG. 21 is to separate a control specification for the drive roll and a control specification for the dancer roll actuator 84 from each other.

Each reference symbol in FIG. 21 respectively represents the following content:

P1(s): Transfer function representing a behavior from the drive roll to the tension (actual control target)

P2(s): Transfer function representing a behavior of the dancer roll actuator to the tension (actual control target)

C1(s): Controller calculating the operation amount of the drive roll

C2(s): Controller calculating the operation amount of the dancer roll actuator

GTr*(s): Ideal response of a closed-loop system constituted by C1(s)

This control model introduces the result of control by C1(s) and the result of control by C2(s) into the design of the control system by taking into consideration the difference in performance of the respective actuators. (Specifically, this control model can be used for designing a 2-input, 1-output multivariable control system.) The control systems are designed such that the C1(s) system is capable of performing slow control and the C2(s) system is capable of performing rapid control. (Specifically, the control systems are designed such that, by weighing indices of "evaluation functions" used as a design guide for each control system in a frequency space, the effect of the C1 system is enhanced in a certain frequency band while the effect of the C2 system is enhanced in another frequency band). This control model achieves a desired motion using the balance between C1(s) and C2(s). (That is to say, the C1 control system constituted by C1 and the C2 system constituted by C2 have respective roles in the frequency space.)

The closed-loop transfer function in the above control model will now be indicated in Equation 17 below.

$$y(t) = \frac{P_1C_1 + P_2C_2}{(I + P_1C_1 + P_2C_2)}r(t) + \frac{1}{I + P_1C_1 + P_2C_2}d(t) \quad \text{[Equation 17]}$$

As described above in relation to the linear approximation model, the tension fluctuation in each unit is affected by the drive rolls before and after the relevant unit. In the third precision improving technique, basically, the tension control for the printing unit 3U is performed by operating the drive roll 85 located before the printing unit 3U, and the tension control for the feed unit 2U and the take-up unit 4U is performed by operating the feed roll 2R and the take-up roll 4R, respectively. In other words, the drive roll used for the control in one unit, on its own, reduces interference of the control itself.

In the printing unit 3U, there are two operation amounts, i.e., the operation amount of the drive roll and the operation amount of the dancer roll actuator 84. The drive roll having a large inertia constitutes a rough tension feed-back control system of the printing unit 3U and compensates for a basic stability. In such control, the C1 system is designed so as to compensate for the basic stability as a whole and the C2 system is designed so as to have response characteristics that suppress disturbance, in consideration of the difference in properties between P1 and P2.

In the roll-to-roll printing apparatus 1 of the present embodiment, by arranging the dancer roll actuator 84 capable of performing ultra-high purity tension control between the drive rolls and causing the dancer roll actuator 84 itself to function as an actuator for tension control (which is, so to speak, a new dancer roll unit), it is possible to give the drive rolls and the dancer roll actuator 84 different roles in the compensation for tension fluctuation based on the difference in their operation performances. In such configuration, a relatively rough control is performed by the drive rolls and the drive roll actuators 76 and a relatively fine control is performed by the ultra-high precision dancer roll actuator 84 to thereby achieve both the broad operable range and the fine tension control performance which would be difficult to be achieved by either one of the control methods.

[B. Roll-to-Roll Printing Apparatus Capable of Performing Multilayer Printing (Overlay Printing)]

A roll-to-roll printing apparatus 1 capable of performing multilayer printing (overlay printing) will now be described below (see FIG. 22).

The roll-to-roll printing apparatus 1 is configured as a system including a plurality of printing units 3U (for example, three (first to third) printing units), which are capable of performing overlay printing.

Figure 22:
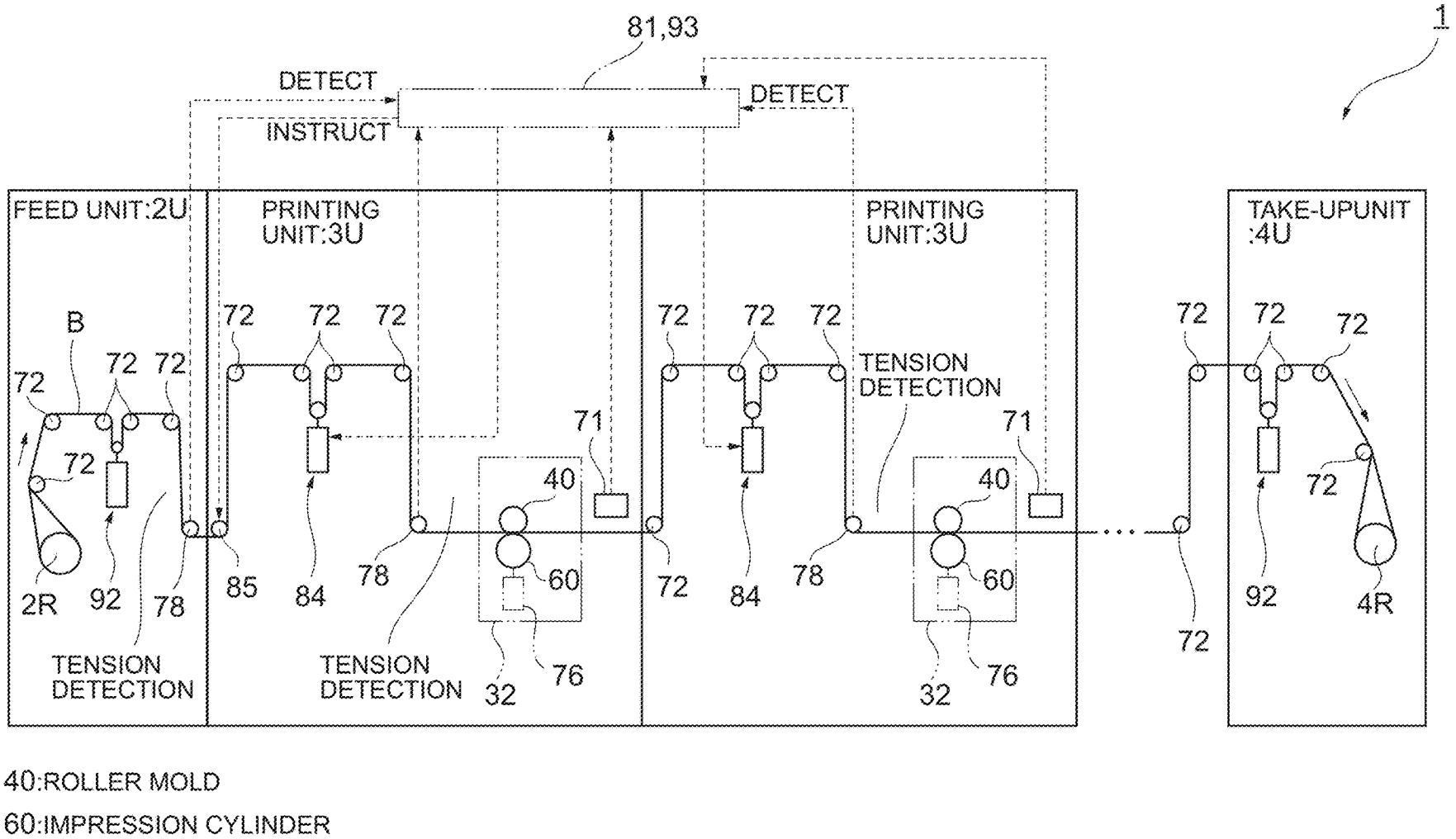
FIG. 22 is a diagram explaining a co-operation control between a tension control and an alignment control in a roll-to-roll printing apparatus which performs overlay printing using a plurality of printing units.

The second and third printing units 3U in the roll-to-roll printing apparatus 1 are each provided with the tension sensor 78 and the print distortion detecting camera 71 (see FIG. 22). The tension sensor 78 may be arranged, for example, before the printing part 32, to detect the tension of the substrate B at that position and transmit a detection signal to the tension control device 81 in the tension control system. The print distortion detecting camera 71 may be arranged, for example, after the printing part 32 to transmit an image signal of an overlay-printed portion to a tension control device 93 in an alignment control system for use in the detection of an alignment mark serving as a reference in the alignment control.

The tension control device 81 in the tension control system controls the drive roll actuator 76 in each of the first to third printing units 3U based on the tension signal detected by the tension sensor 78 to compensate for the tension fluctuation of the substrate B. The tension control device 93 in the alignment control system analyzes the image captured by the print distortion detecting camera 71 to detect misalignment in the overlaid portion and controls the dancer roll actuator 84 so as to compensate for the tension fluctuation of the substrate B and reduce the alignment error. The tension control device in the tension control system and the tension control device in the alignment control system are cooperatively controlled by a control device included in a cooperation control system to thereby compensate for the tension fluctuation and to create a steady state with the suppressed tension fluctuation and improve the alignment precision by reducing the alignment errors.

<Control Model>

The tension control model in the roll-to-roll printing apparatus 1 capable of performing multilayer printing (overlay printing) has the following characteristics (4) and (5), in addition to characteristics (1) to (3) described above.

(4) The alignment model depends on a difference between a component affected by a tension fluctuation in a previous printing unit after a time required for the substrate to reach each printing unit 3U and a component affected by a tension fluctuation in each printing unit. Since a difference between a print position in a previous printing unit and a print position in a printing unit of interest is an alignment error, control is performed so as to suppress such difference.

Next, the following description will describe an example of precision improving techniques for the tension control in the roll-to-roll printing apparatus 1 capable of performing multilayer printing (overlay printing), as a "fourth precision improving technique."

<Fourth Precision Improving Technique>

Figure 23:
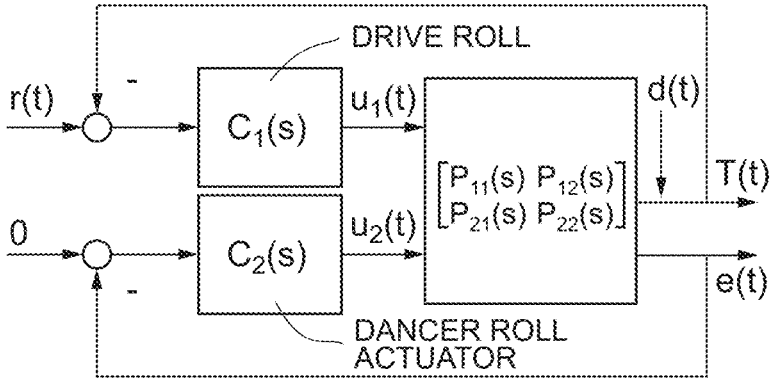
FIG. 23 is a diagram showing a control model in a fourth precision improving technique of the tension control in the roll-to-roll printing apparatus.

A basic strategy of the control model shown in FIG. 23 is to separate a control specification for the drive roll 85 and a control specification for the dancer roll actuator 84 from each other.

The reference symbols in FIG. 23 respectively represents the following content:

P11(s): Actual transfer function of a control target with a speed instruction to the drive roll being an input and a tension fluctuation being an output P12(s): Actual transfer function of a control target with a load instruction (or a position instruction) to the high precision dancer roll actuator being an input and a tension fluctuation being an output P21(s): Actual transfer function of a control target with a speed instruction to the drive roll being an input and an alignment error being an output P22(s): Actual transfer function of a control target with a load instruction (or a position instruction) to the high precision dancer roll actuator being an input and an alignment error being an output C1(s): Controller calculating the operation amount of the drive roll C2(s): Controller calculating the operation amount of the high precision dancer roll actuator This control model is applicable for separating the control specification for the drive roll 85 and the control specification for the dancer roll actuator 84 (basic strategy). Such control model can improve the stability of the alignment control and following capability of the target value by taking into consideration interference between the tension control device 81 of the tension control system and the tension control device 93 of the alignment control system.

<Configuration of Control Methods>

The following description will describe (A) a control method in the roll-to-roll printing apparatus 1 for a single-layer printing (optimization control in a single unit), and (B) a control method in the roll-to-roll printing apparatus 1 capable of performing multilayer printing (overall optimization).

(Optimization Control in a Single Unit)

Existence of a large alignment error indicates that a large tension fluctuation is generated in a previous section (a "section" herein refers to each layer in a plurality of layers formed on the substrate B by overlay printing) or in a current section. However, the existence of a large tension fluctuation does not necessarily result in a large alignment error. The reason for this is that, if a tension fluctuation of the same magnitude as that of the tension fluctuation generated in the previous section is produced on purpose in consideration of the transfer time, an alignment error will not be generated. For this reason, improvement of the tension control performance is inevitable for suppressing the alignment error. Further, for the same reason, the alignment control performance can be improved even at the expense of the tension fluctuation.

Although the stabilization of the tension control is basically achieved by the C1 system, it is also possible to establish a C2 system intended to suppress the alignment error for the same reason as above. A control intended to suppress the alignment error would possibly generate a tension fluctuation; however, since the effect of a micromotion of the high precision dancer roll actuator 84 that is operated for fine adjustment in the high precision alignment control on the tension fluctuation is considered to be small, it is still possible to achieve high precision alignment control.

(Overall Optimization)

Since an operation in a previous unit affects the next unit and an alignment error is a difference between a print position in a previous section and a print position in the current section, an earlier unit/section affects a later unit/section. The amount of such effect is estimated using a model, and a feed-forward control system is designed so as to cancel out such effect in advance. More specifically, two types of feed-forward control systems are used, i.e., a tension feed-forward control system between the units and an alignment feed-forward control between the sections.

Figure 24:
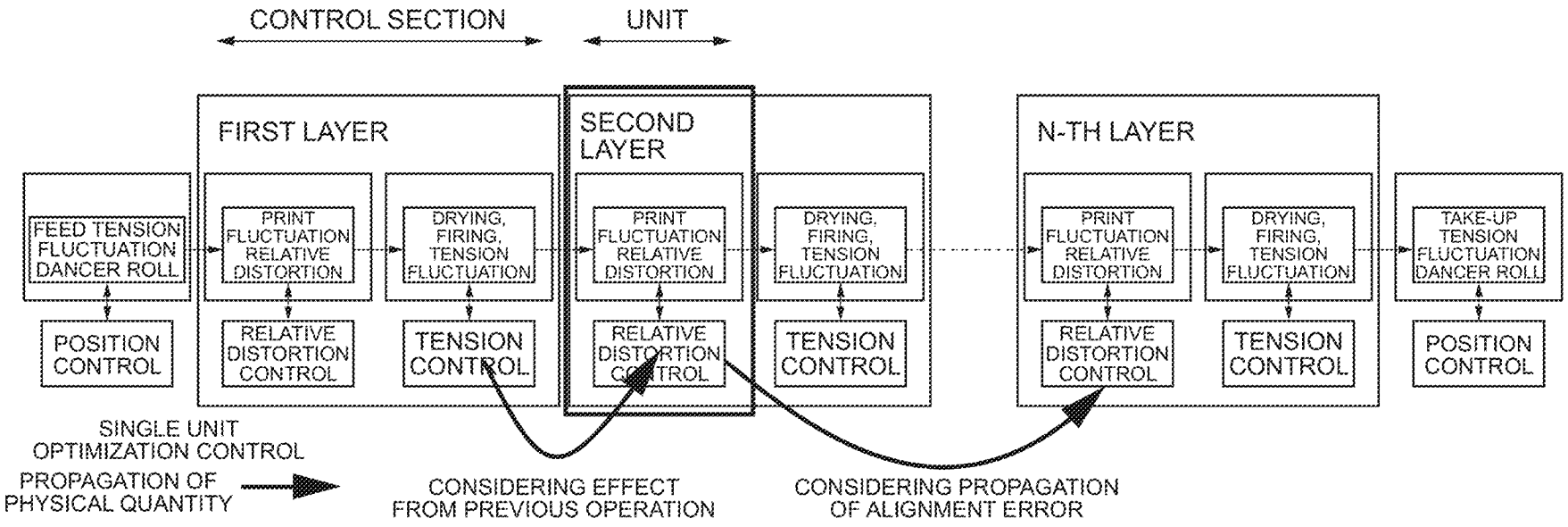
FIG. 24 is a diagram showing an outline of an overall optimization (a co-operation control taking into consideration an inference between units).

FIG. 24 shows the outline of the overall optimization (cooperation control that takes interference between units into consideration). In the above-described optimization control in a single unit, the disturbance suppression, stability and following capability are quantified and evaluated. On the other hand, in the cooperation control that takes the interference between units into consideration, in order to optimize a system with a physical interference, feed-forward control is performed in consideration of the operation amount in a previous unit and propagation of the resulting overlay error. In view of the above, in the roll-to-roll printing apparatus 1 of the present embodiment, optimization of a single unit is performed and the control system is designed in consideration of the fact that an operation or a phenomenon in a previous unit propagates to the next unit. In order to achieve such control system, it is necessary to quantify and grasp a phenomenon that occurs in each unit and that may affect the next unit.

It should be noted that the above-mentioned embodiments are examples of preferred embodiments of the invention and the invention is not limited to the above-mentioned embodiments and various modifications may be made without departing from the gist of the invention. For example, it is possible to apply model predictive control in which control is performed while performing online prediction using a model.

INDUSTRIAL APPLICABILITY

The present invention is suitably applicable to an apparatus which uses a roller mold to perform printing on a substrate using a roll-to-roll method.

REFERENCE SIGNS LIST

1 roll-to-roll printing apparatus (printing apparatus)
2 feed device
2*u* feed unit
3 reverse printing device
3*u* printing unit
4 take-up device
4*u* take-up unit
5 roller
20 ink supply member
30 blanket cylinder
40 roller mold
42 roller mold nip device
42*e* force point
44 slider
46 base
49 guide member
50 roller mold cleaning member
60 impression cylinder
62 impression cylinder nip device
70 air blowing device
71 print distortion detecting camera
72 free roll
76 drive roll actuator
78 tension sensor
80 moving resistance reduction device
81 tension control device
82 air supply part
83 piston
84 dancer roll actuator
84*b* air bearing
85 in-feed roll (drive roll)
85*s* position sensor
86 servo valve
87 exhaust part
88 control device

89 air pad
90 air blowing port
91 air guide
92 dancer roll
B substrate
C center of gravity of devices
D moving direction of the slider
K ink
Sa axis of symmetry

What is claimed is:

1. A printing apparatus that performs printing on a substrate using a roll-to-roll method, the apparatus comprising:
an ink supply member that supplies a printing ink;
a blanket cylinder that transfers part of the ink, which has been supplied from the ink supply member and applied on a surface of the blanket cylinder, onto the substrate;
a roller mold that removes part of the ink applied on the surface of the blanket cylinder;
a base on which the blanket cylinder is fixed;
a slider that supports the roller mold and moves on the base;
a roller mold nip device that applies to the roller mold a nip pressure against the blanket cylinder; and
a moving resistance reduction device that reduces a moving resistance of the slider relative to the base, wherein the moving resistance reduction device is an air blowing device that floats the slider above the base.

2. The printing apparatus according to claim 1, wherein the roller mold nip device controls pressing force applied to the slider using the nip pressure as a parameter.

3. The printing apparatus according to claim 1, wherein the roller mold nip device presses the slider via a force point.

4. The printing apparatus according to claim 3, wherein the force point is arranged at the same height as a height of an axis of rotation of the roller mold.

5. The printing apparatus according to claim 1, wherein the air blowing device is provided with the slider, and the air blowing device comprises air blowing ports through which the air is blown out to the base.

6. The printing apparatus according to claim 5, wherein the air blowing ports are arranged in line symmetry with respect to an axis of symmetry perpendicular to a moving direction of the slider.

7. The printing apparatus according to claim 1, wherein the slider includes air pads or air guides which configure the air blowing device.

8. The printing apparatus according to claim 7, wherein the air pads are arranged in an equal distance from the center of gravity of the slider and devices supported by the slider.

9. The printing apparatus according to claim 1, further comprising a guide member that guides the slider in a direction which causes the roller mold to move to and away from the blanket cylinder.

10. The printing apparatus according to claim 9, wherein the guide member guides the slider in a direction perpendicular to an axis of rotation of the blanket cylinder.

11. The printing apparatus according to claim 1, wherein the roller mold, the blanket cylinder and an impression cylinder that presses the substrate into contact with the blanket cylinder are arranged in a linear manner.

12. The printing apparatus according to claim 11, wherein an axis of rotation of the roller mold, an axis of rotation of the blanket cylinder, and an impression cylinder that presses the substrate into contact with the blanket cylinder are arranged on a horizontal plane.

13. The printing apparatus according to claim 11, wherein the ink supply member, the roller mold and the impression cylinder are arranged around the blanket cylinder, in order of mention in a rotation direction of the blanket cylinder.

14. The printing apparatus according to claim 1, wherein an axis of rotation of the blanket cylinder is fixed and the roller mold is provided so as to be moveable relative to the blanket cylinder.

15. The printing apparatus according to claim 1, wherein the blanket cylinder is formed of PDMS.

16. A reverse printing apparatus comprising the printing apparatus according to claim 1, the reverse printing apparatus further comprising a printing plate cleaning member that cleans the roller mold and strips off ink that has adhered to the roller mold, wherein the printing apparatus performs seamless reverse printing on the substrate.

17. The reverse printing apparatus according to claim 16, wherein the printing plate cleaning member is a roller mold cleaning member that is provided in an integrated manner with the roller mold.

* * * * *